US009290294B2

(12) United States Patent
Laughman et al.

(10) Patent No.: US 9,290,294 B2
(45) **Date of Patent: *Mar. 22, 2016**

(54) METHOD FOR MANUFACTURING A DUAL-PURPOSE CONTAINER AND A CONTAINER PRE-ASSEMBLY HAVING A TEAR-OUT SECTION, AND THE PRE-ASSEMBLY AND THE CONTAINER

(71) Applicant: YORK CONTAINER COMPANY, York, PA (US)

(72) Inventors: Jamie L. Laughman, East Berlin, PA (US); Troy M. Little, Thomasville, PA (US)

(73) Assignee: YORK CONTAINER COMPANY, York, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/539,524

(22) Filed: Nov. 12, 2014

(65) Prior Publication Data

US 2015/0060538 A1 Mar. 5, 2015

Related U.S. Application Data

(63) Continuation-in-part of application No. 13/630,005, filed on Sep. 28, 2012, now Pat. No. 8,887,985.

(60) Provisional application No. 61/541,516, filed on Sep. 30, 2011.

(51) Int. Cl.

| | |
|---|---|
| ***B65D 5/42*** | (2006.01) |
| ***B65D 5/48*** | (2006.01) |
| ***B65D 5/16*** | (2006.01) |
| ***B65D 5/54*** | (2006.01) |
| ***B31B 1/26*** | (2006.01) |

(52) U.S. Cl.
CPC . *B65D 5/542* (2013.01); *B31B 1/26* (2013.01); *B65D 5/16* (2013.01); *B65D 5/48014* (2013.01); *B65D 5/541* (2013.01)

(58) Field of Classification Search
CPC ..... B65D 5/542; B65D 5/16; B65D 5/541; B65D 5/522; B65D 5/5226; B65D 5/5233; B65D 5/524
USPC ..... 229/161, 162.3, 165, 182, 240, 241, 229/242; 206/45.29, 772, 774
See application file for complete search history.

(56) References Cited

U.S. PATENT DOCUMENTS

| | | | | | |
|---|---|---|---|---|---|
| 1,649,211 | A | * | 11/1927 | Bitzer | B65D 5/522 206/45.28 |
| 2,136,797 | A | * | 11/1938 | Lee | B65D 5/4225 206/767 |
| 2,914,236 | A | * | 11/1959 | Shapiro | B65D 5/3642 206/767 |
| 3,377,016 | A | * | 4/1968 | Bates | B65D 5/2085 229/161 |
| 3,961,706 | A | * | 6/1976 | Roccaforte | B65D 5/52 206/736 |
| 5,842,576 | A | * | 12/1998 | Snow | B65D 5/5445 206/736 |
| 5,950,914 | A | * | 9/1999 | Dunton | B65D 5/5405 229/122 |
| 6,189,780 | B1 | | 2/2001 | Kanter | |
| 6,874,679 | B2 | | 4/2005 | Tibbles et al. | |
| 6,948,617 | B2 | | 9/2005 | Kanter et al. | |
| 7,331,508 | B2 | | 2/2008 | Kanter et al. | |
| 7,484,654 | B2 | | 2/2009 | Tibbles et al. | |

(Continued)

*Primary Examiner* — Gary Elkins
(74) *Attorney, Agent, or Firm* — Barnes & Thornburg LLP

(57) ABSTRACT

A method for manufacturing a container pre-assembly and a container having a combination panel and a tear-out section, the tear-out section configured to be separated from an erected container.

23 Claims, 25 Drawing Sheets

(56) References Cited

U.S. PATENT DOCUMENTS 8,302,845 B2 11/2012 Bell et al.
8,763,888 B2 * 7/2014 Willman ..... B65D 5/10 229/114
8,887,985 B2 * 11/2014 Laughman ..... B65D 5/42 206/774
2006/0060643 A1 * 3/2006 Sheffer ..... B65D 5/22 229/242
2010/0224675 A1 9/2010 Bell et al.
2013/0001236 A1 * 1/2013 Block ..... B65D 5/443 220/654
2013/0150224 A1 * 6/2013 DeCello ..... B65D 5/5445 493/405

* cited by examiner

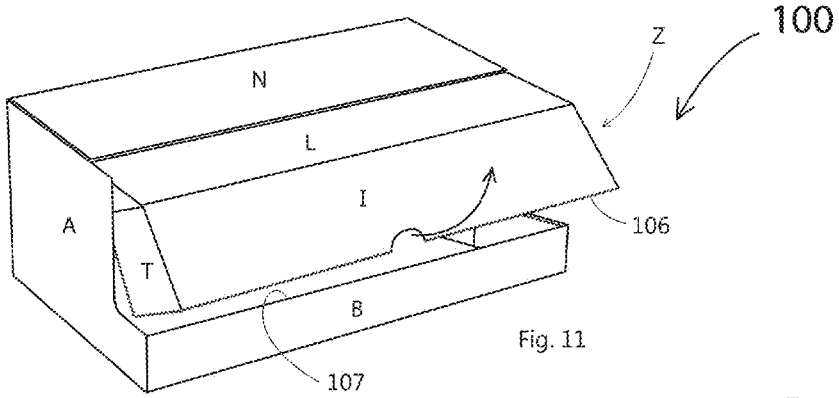
Fig. 11
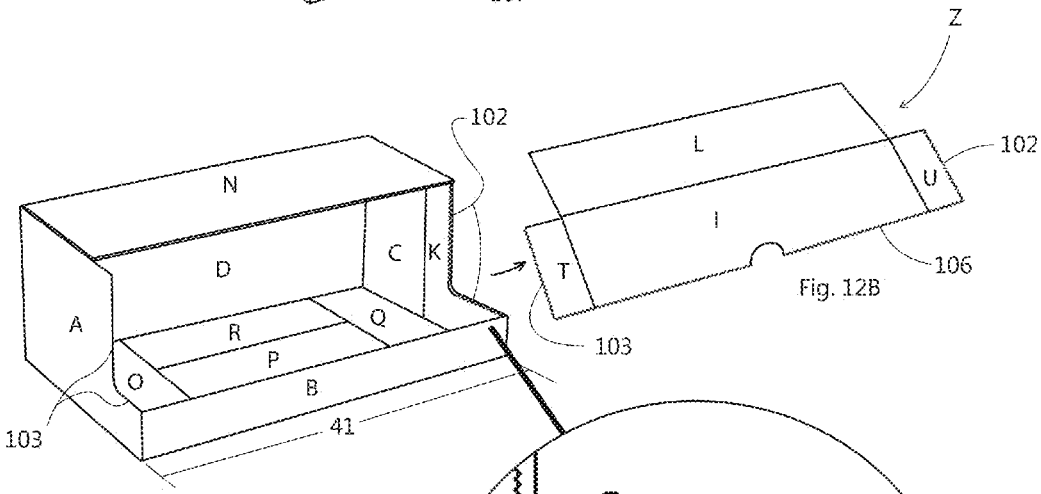
Fig. 12B
Fig. 12A
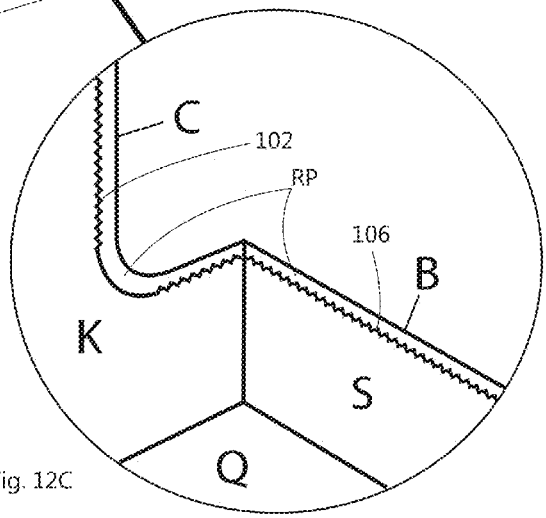
Fig. 12C

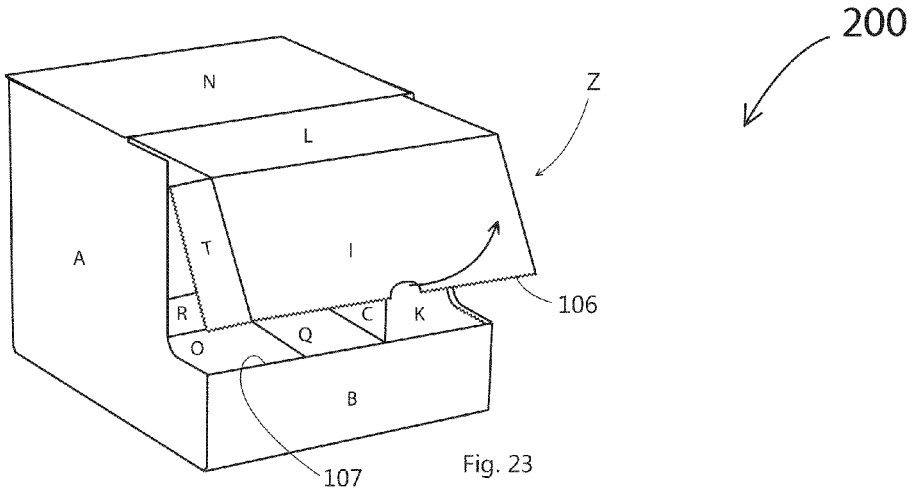
Fig. 23
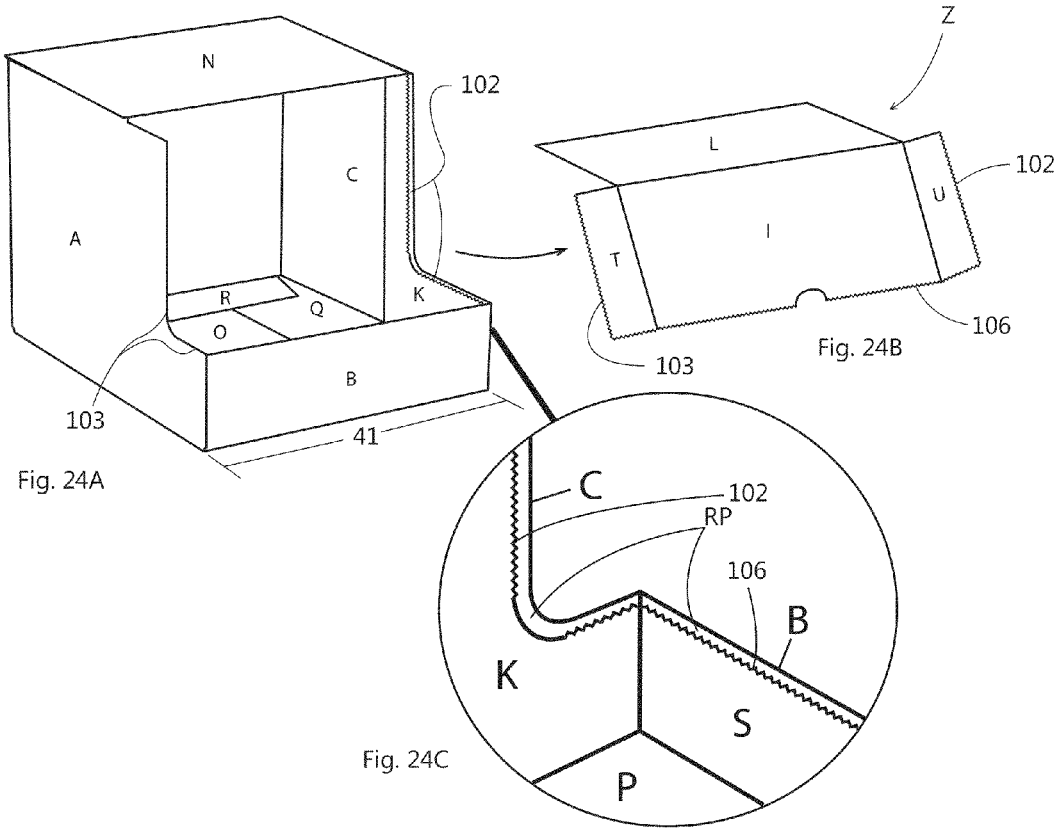
Fig. 24A
Fig. 24B
Fig. 24C

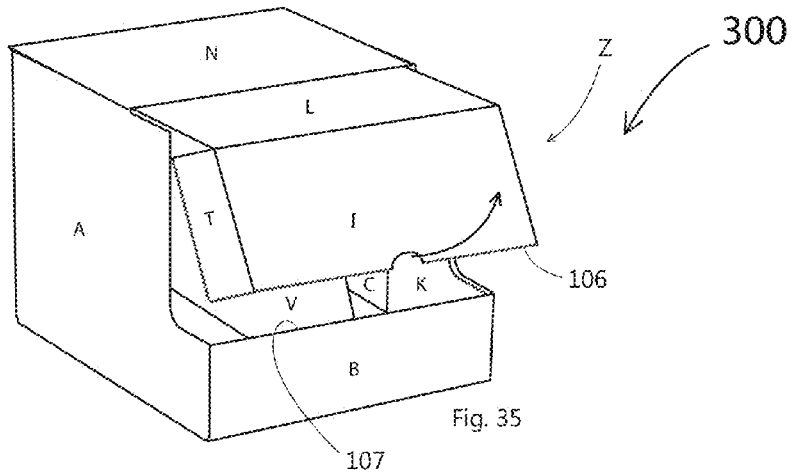
Fig. 35
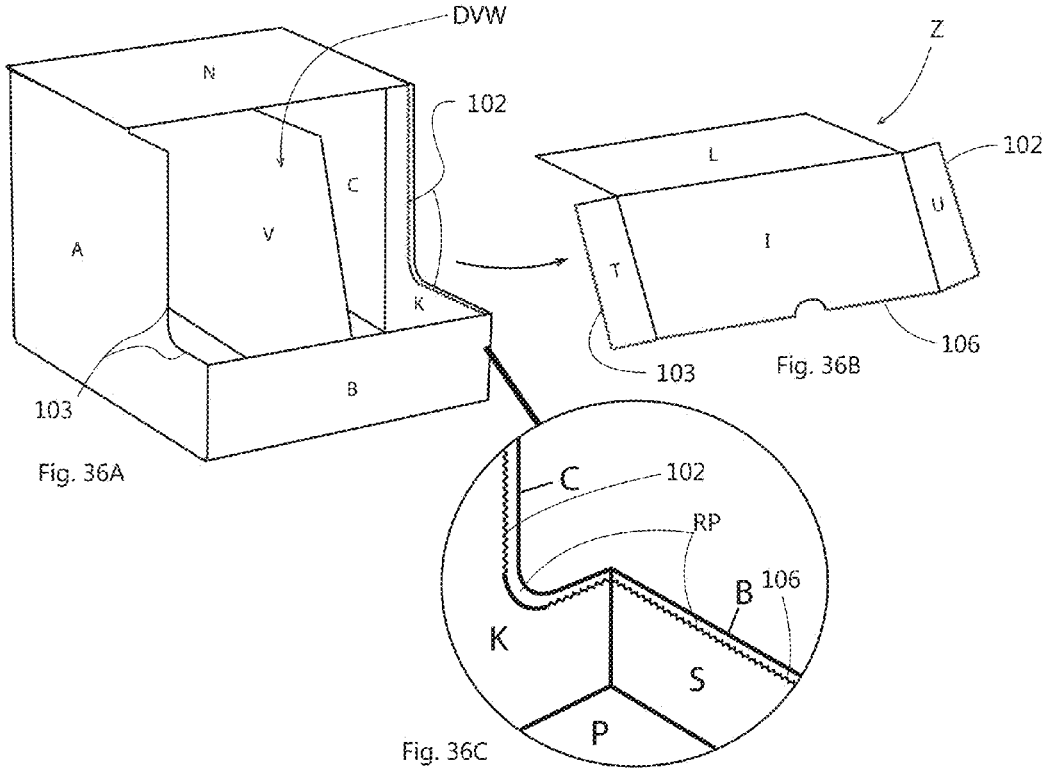
Fig. 36A
Fig. 36B
Fig. 36C

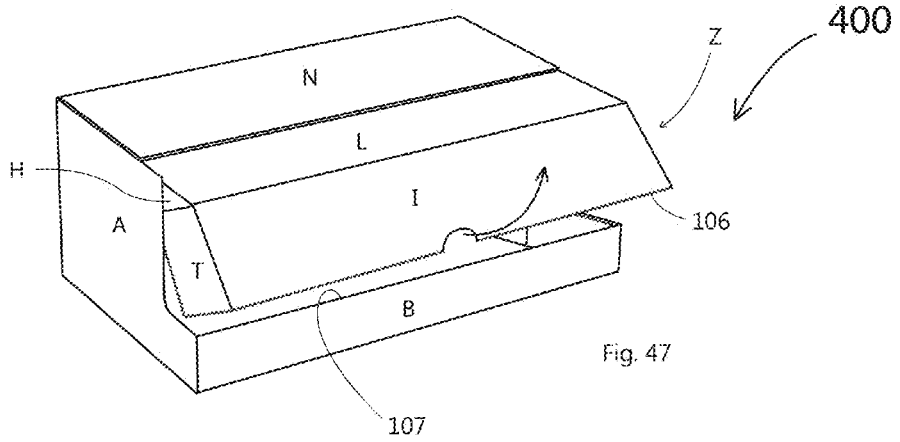
Fig. 47
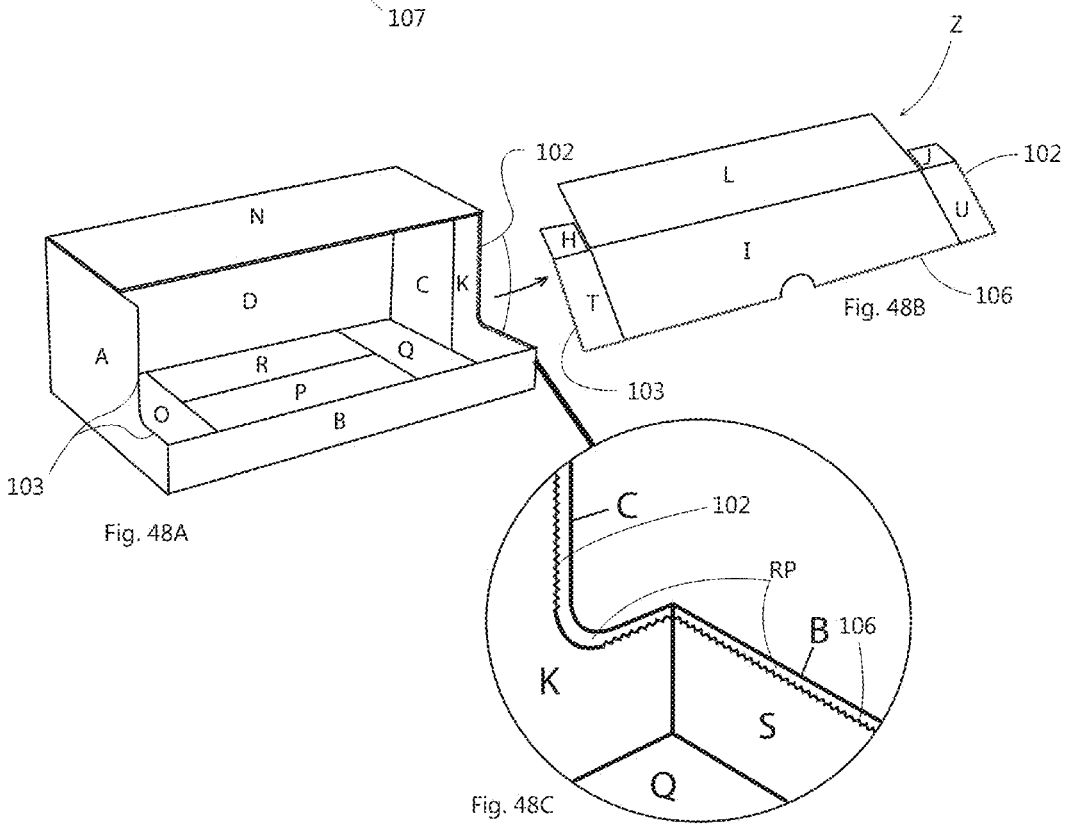
Fig. 48A
Fig. 48B
Fig. 48C

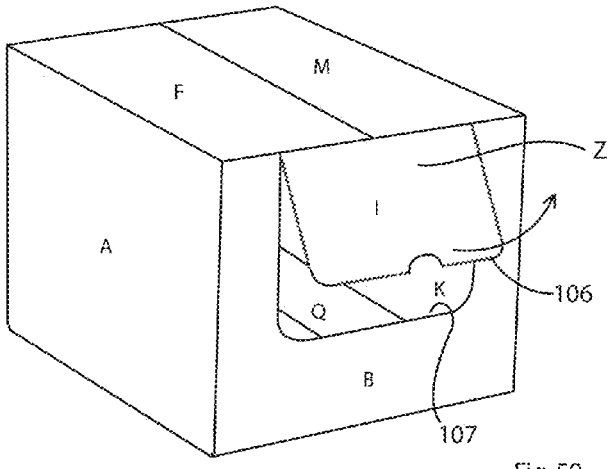
Fig. 59
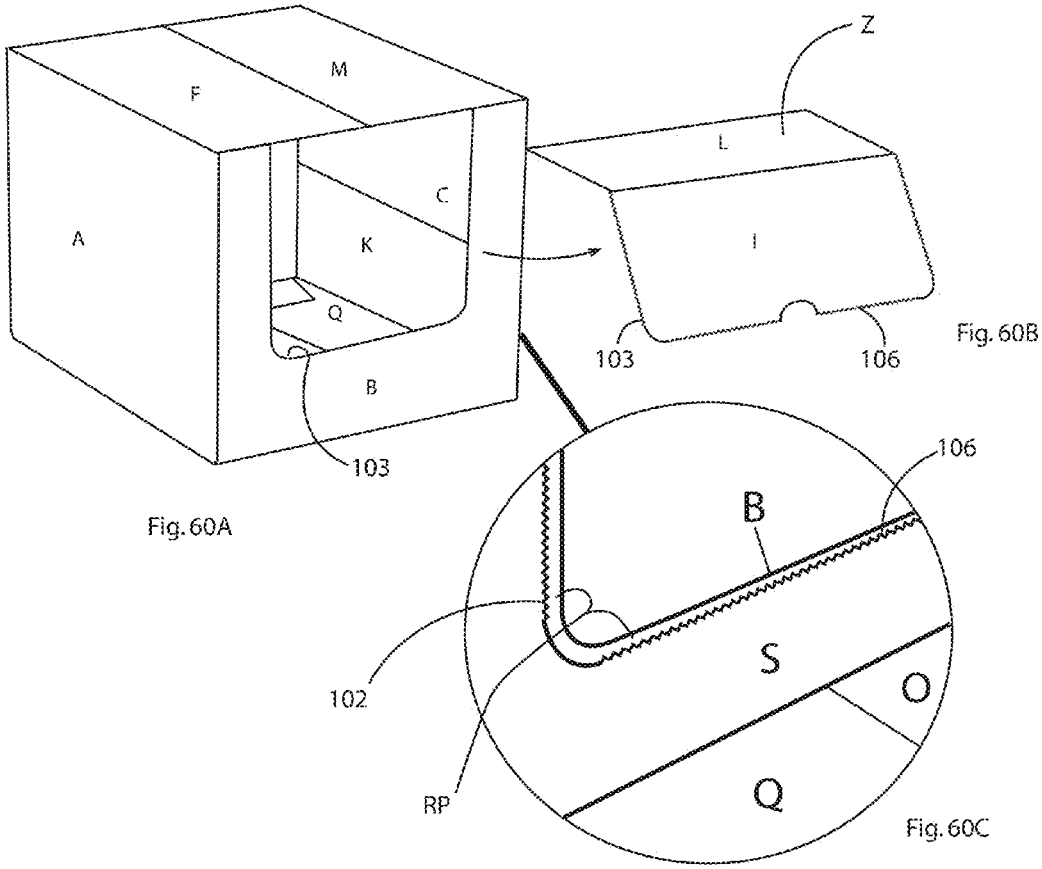
Fig. 60A
Fig. 60B
Fig. 60C

METHOD FOR MANUFACTURING A DUAL-PURPOSE CONTAINER AND A CONTAINER PRE-ASSEMBLY HAVING A TEAR-OUT SECTION, AND THE PRE-ASSEMBLY AND THE CONTAINER

This application is a continuation-in-part of U.S. patent application Ser. No. 13/630,005, filed Sep. 28, 2012, which claims benefit of U.S. Provisional Patent Application No. 61/541,516, filed Sep. 30, 2011, the contents of which are incorporated herein by reference in their entireties.

BACKGROUND AND SUMMARY

The present disclosure relates, in general, to the manufacture of packaging or containers that may be readily used to transport product and/or display the contents of the containers following delivery to a customer.

Suppliers of containers or container pre-assemblies are being pushed by retailers to supply containers or packaging that is dual purpose. The containers need to be able to be shipped and carry product safely to a store. The containers then must be easily converted, without any knives or tools, into a display case that can be easily placed on a shelf. The challenge is remaining cost effective, especially when the supplier may be currently utilizing just a standard brown box shipping container.

A basis of the container pre-assembly and the container of present disclosure thus includes a one-piece blank that can withstand the stress of shipping while also meeting the needs of a container that includes a display feature for the retail environment.

As suggested above, various packages and containers are conventionally provided for transporting product to and storing product in a retail environment and for ultimate display to prospective customers, such as consumers. As is conventionally known in the packaging industry, such containers can be transported to manufacturing and/or retail environments for display in knock-down form, that is, in a flattened condition known as a pre-assembly, but otherwise having panels of the flattened pre-assembly being glued, stapled or otherwise affixed or joined together such that the panels are substantially in a pre-assembled state. In such a pre-assembled or knock-down state, personnel assembling or erecting the container need only open, or spread apart selected panels of the container and affix two or more of the panels together into an assembled condition of the container. Such final assembly of the container is performed prior to loading a selected product into the container. The product that is placed into the resulting assembled container may then be shipped to a wholesaler's or retailer's location. After the product is loaded into the container, the container may be ready for shipment and display or may have portions of the container needing to be removed in order to be ready for display.

Conventionally, the top of container may be closed and sealed by sequentially overlapping the top panels or by the use of tape or glue, for example, to adhere the top panel or panels to each other or to other panels of the container.

According to the present disclosure, a container pre-assembly and a container, as well as a method for manufacturing the container pre-assembly and the container, includes a blank having a plurality of panels. The plurality of panels includes a combination panel that is configured to be rotated and folded such that selected panels of the combination panel, such as, for example, a panel that may be considered conventionally as a front panel and a panel that may be conventionally considered as at least one of the top panels, respectively, switch positions to form one of the top panels and to form a portion of a front panel, respectively. Both of those "switched" panels are configured to be ultimately torn away as a tear-out section from the assembled container, for example, at the retail environment, to provide access to product located in an interior of the assembled container.

In accordance with illustrated embodiments, a method of manufacturing a container and the resulting container, and a method of manufacturing an associated container pre-assembly and the resulting container pre-assembly, as well as the blank, are disclosed herein. When the methods and the blank are utilized as disclosed herein, it results in container pre-assemblies and containers having an interior formed by the blank, which blank serves also as an exterior of the assembled container. The interior of the container may include a divider member.

Thus, one of the key features of embodiments of the present disclosure (see FIGS. 1-48) includes a blank that includes a combination panel. The combination panel includes a top panel, portions of panels designated as front panels, end areas, and tab portions. The combination panel may also include top panel tabs. An advantageous feature of the combination panel is that it is configured to rotate about hinge lines or score lines which rotation causes what would conventionally be considered as a top panel of a container (see panel and its position on the blank in FIG. 2 to convert into a front panel and thus is designated herein as a third portion of the front panel (see FIG. 4). Similarly, the rotation of the combination panel causes what would conventionally be considered as a front panel of a container, see panel and its position on the blank in FIG. 2, to convert into a top panel and thus is designated herein as a second top panel (See FIG. 4). This simple advantage of rotating the combination panel and the placement of selected panels, end areas, and tab portions provides for a tear-out section (see FIGS. 11 and 12A-12C, for example) that allows access to the product in the container, provides for a reinforced remaining front panel portions, and hides perforation edges after the tear-out section is separated from the container.

Other features of embodiments of the present disclosure, as noted above, include the window tear-out section that provides access to an interior of the container for the ultimate purchaser of the product displayed in the container. In addition, perforated edge of the tear-out section is recessed behind a part of the remaining front panel that is left after the tear-out section is separated from the container. Also, other perforated edges of the tear-out section are recessed behind the first and second end areas of the combination panel after the tear-out section is separated at those edges from the container. The recessing of the perforated edges forming recessed portions RP gives the front of the container a clean appearance on, for example, a retailer's shelf. The ragged or torn perforated edges or perforations are not seen by the consumer.

Additional features of embodiments of the present disclosure include the first top panel configured and acting as a stacking support so that multiple containers can be vertically stacked upon one another even after the tear-out section is separated from the containers. Also, there is the advantageous feature of the remaining front panels, after the tear-out section is removed, being reinforced as a result of the combination panel being rotated on the blank such that the first and second portions of the front panel are adhered to each other during manufacturing of the container pre-assembly.

A more complete understanding of the embodiments of the present disclosure and the utility thereof may be acquired by referring to the following in consideration of the accompanying drawings and the description of the embodiments. Generally, in the drawings and the description, like reference numbers indicate like features.

In the FIGS. 1-60C, the lines shown separating or connecting various panels, end areas, panel portions, and tabs may be considered as fold lines, score lines, hinge lines and/or perforated lines or edges.

Other aspects of the present disclosure will become apparent from the following descriptions when considered in conjunction with the accompanying drawings.

BRIEF DESCRIPTION OF THE DRAWINGS

FIG. 11 illustrates a perspective view of a first step of a separation of a tear-out section (Z) from the container of FIG. 10, in accordance with the present disclosure.

FIGS. 12A and 12B illustrate perspective views of the container and the tear-out section (Z) separated from the container of FIG. 11.

FIG. 12C illustrates an enlarged view of a corner of the container of FIG. 12A showing the perforated edges (102, 106) and recessed portions (RP).

FIG. 23 illustrates a perspective view of a first step of a separation of a tear-out section (Z) from the container of FIG. 22, in accordance with the present disclosure.

FIGS. 24A and 24B illustrate perspective views of the container and the tear-out section (Z) separated from the container of FIG. 23.

FIG. 24C illustrates an enlarged view of a corner of the container of FIG. 24A showing the perforated edges (102, 106) and recessed portions (RP).

FIG. 35 illustrates a perspective view of a first step of a separation of a tear-out section (Z) from the container of FIG. 34, in accordance with the present disclosure.

FIGS. 36A and 36B illustrate perspective views of the container including the divider panel (V) and also showing the tear-out section (Z) separated from the container of FIG. 35.

FIG. 36C illustrates an enlarged view of a corner of the container of FIG. 36A showing the perforated edges (102, 106) and recessed portions (RP).

FIG. 47 illustrates a perspective view of a first step of a separation of a tear-out section (Z) from the container of FIG. 22, in accordance with the present disclosure.

FIGS. 48A and 48B illustrate perspective views of the container and the tear-out section (Z) separated from the container of FIG. 47.

FIG. 48C illustrates an enlarged view of a corner of the container of FIG. 48A showing the perforated edges (102, 106) and recessed portions (RP).

FIG. 59 illustrates a perspective view of a first step of a separation of a tear-out section (Z) from the container of FIG. 58, in accordance with the present disclosure.

FIGS. 60A and 60B illustrate perspective views of the container and the tear-out section (Z) separated from the container of FIG. 59.

FIG. 60C illustrates an enlarged view of a corner of the container of FIG. 60A showing the perforated edges (102, 106) and recessed portions (RP).

DETAILED DESCRIPTION

Figure 1:
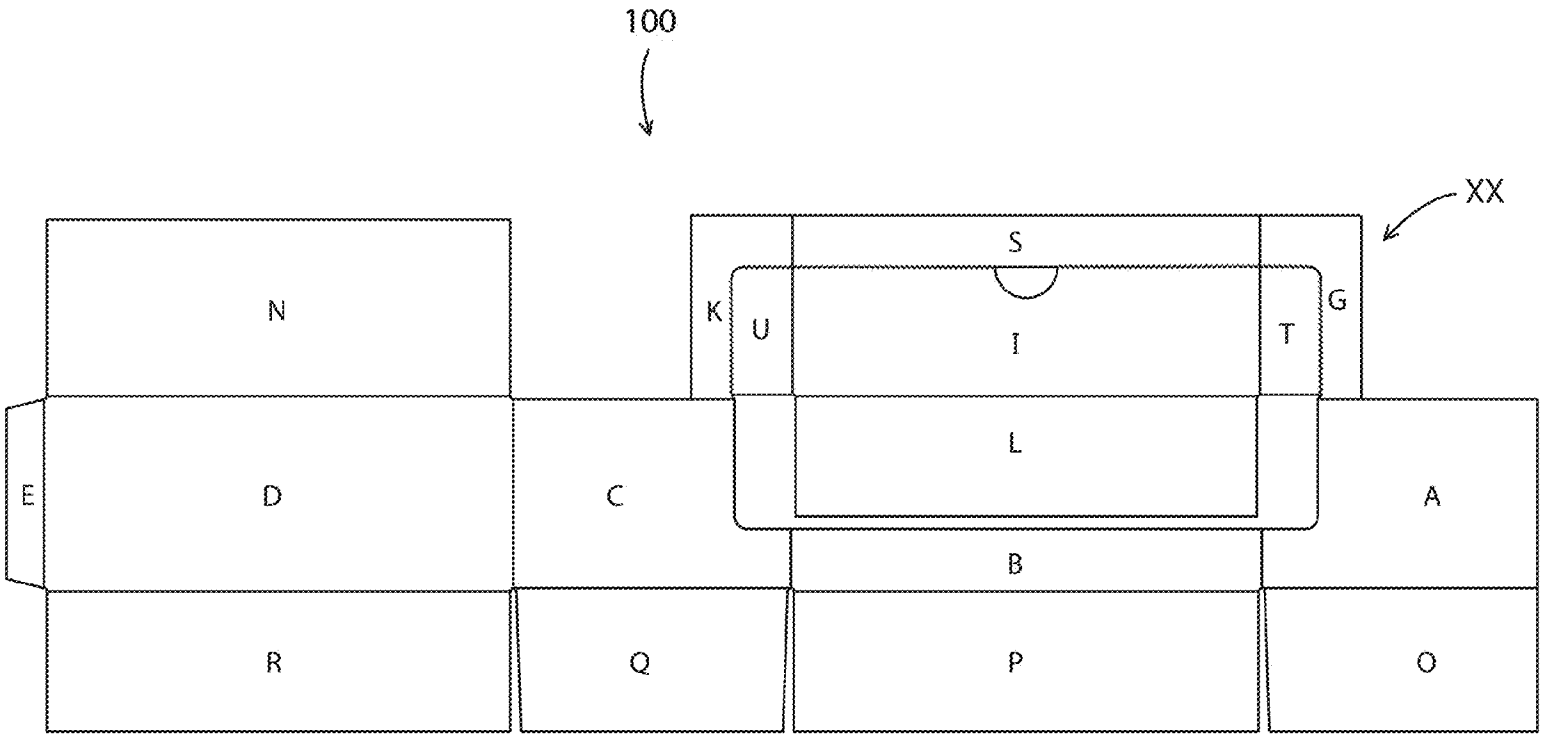
FIG. 1 illustrates a plan view of a blank used for manufacturing a container pre-assembly and a container in accordance with a first embodiment, according to the present disclosure.

In the following description of an embodiment or embodiments in accordance with the present disclosure, reference is made to the accompanying drawings. It is to be understood that other embodiments, in accordance with the present disclosure, may be utilized and structural and functional modifications may be made without departing from the scope and spirit of the embodiments of present disclosure presented herein.

The manufacture and use of containers that may be used for more than one purpose, e.g., for transport of product and subsequent display of product in a retail environment, are becoming increasingly popular among both manufacturers and retailers because such containers enable a reduction or minimization of the amount of container material while increasing or maximizing the amount of display space available for product. Thus, it is conventionally known that a blank or blanks, e.g., items made from some type of paperboard and/or other material that is die-cut and scored for subsequent manipulation to form a pre-assembly or pre-assemblies, e.g., a partially assembled container wherein the blank, or blanks, is manipulated and affixed to itself, or to each other but is not finally erected or assembled. Containers, e.g., packaging, cartons, boxes, etc., made from the pre-assembly or pre-assemblies, may be provided that enable product to be transported to a retail environment in a transporting container and displayed in the retail environment within the transporting container. Minor modification of the container may be required.

The durability, strength and stackability of such packaging or containers often require increasing the amount of material content within the container. However, further reducing the amount of material content within containers has become a significant goal of many manufacturers and retailers because of the adverse effect that container has on landfills and the environment in general as well as the cost of manufacturing, transporting and disposing of such containers Thus, both manufacturers and retailers are recognizing a need to reduce the number of containers used to provide product to an end-consumer in a retail supply chain. Thus, is done in an effort to conserve natural resources, reduce an impact on the environment, improve efficiency by saving the time it takes to erect a container by reducing the number of human touches it takes, and reduce costs associated with product manufacture and sale. In an effort to achieve these goals, various initiatives have been put in place by both suppliers and retailers to reduce the overall number of product containers and the materials used therein by some percentage, e.g., five percent.

One conventional mechanism for reducing the amount of containers necessary to provide product to potential consumers in a retail environment is by providing dual-use containers wherein a container can be used both to contain product during transporting and also to display the product once that product has arrived in a retail environment, e.g., a store or other environment offering product for sale.

Further, in an effort to further use available space in a retail environment, retailers may be interested in using the display function of such dual-use containers in a manner such that containers may be stacked on top of one another to improve or optimize vertical space utility in the retail environment. Simply put, having the ability to be able to stack display cartons enables a store operator to present more product and/or different types of product in a manner that a customer can see. For example, by providing the opportunity to stack such containers, e.g., display cartons, on a counter, a store operator is able to increase the use of counter space such that more than one carton can occupy the same horizontal counter foot print. As is understood in the retail industry, such a configuration increases sales because customers are able to see more available product and product types for sale.

However, a problem with stacking such display cartons and shipping cartons, whether such packaging is dual-use transporting/display containers or otherwise, is that the weight of the carton(s) in combination with the weight of the product(s) stored in the container(s) can cause one or more containers to be damaged or collapse. As a result, a store operator is left with damaged, ineffective or completely non-functioning display container(s), which causes operational problems and reduces likelihood of sales to consumers.

Accordingly, based on all of these factors, there is a need to provide a method of manufacturing reduced-material content-containers and associated pre-assemblies and blanks, which, when utilized, result in a container that has significantly improved stacking strength, or anti-nesting characteristics, over conventional containers and optionally provides the dual use both as a transporting container for transporting product to a retail environment and a display container configured to display the product in that retail environment. With this understanding of one area of packaging/container utility in mind, a description of at least one illustrative embodiment, according to the present disclosure, follows.

According to at least one illustrated embodiment, there is disclosed a shipping container, display container and/or a dual-use container, e.g., for transporting product and subsequent display of the product, as well as corresponding container pre-assemblies and blanks, that includes, overall, a reduced amount of material content while maintaining or increasing the stacking strength of such a container by the use of, for example, internal divider-support sections. Such internal support sections, such as a divider panel, may allow for a reduction of the material in the outer shell of the container leading to an overall reduction in the amount of material. In view of recent retailer initiatives to reduce the amount of material content in containers, such containers may have increased utility to manufacturers and retailers. Thus, providing containers with reduced material content and requiring fewer human touches to erect a container using a manual or an automated process would be of increased value. Additionally, because of the unique structure provided in accordance with the at least one illustrated embodiment, wall strength may be increased as well.

Figure 2:
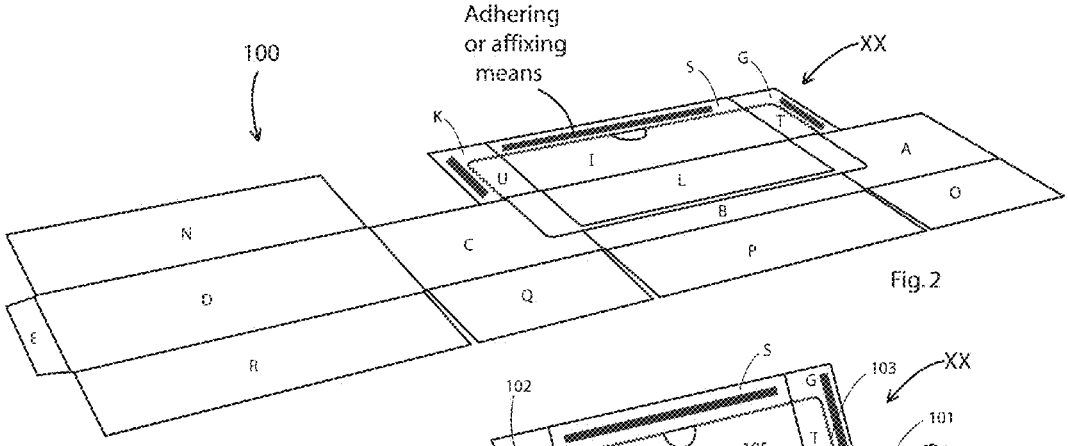
FIGS. 2-5 illustrate perspective views of steps of manufacturing a container pre-assembly from the blank of FIG. 1 and showing the rotation of a combination panel (XX) in FIGS. 2-4, in accordance with the present disclosure.
Figure 3:
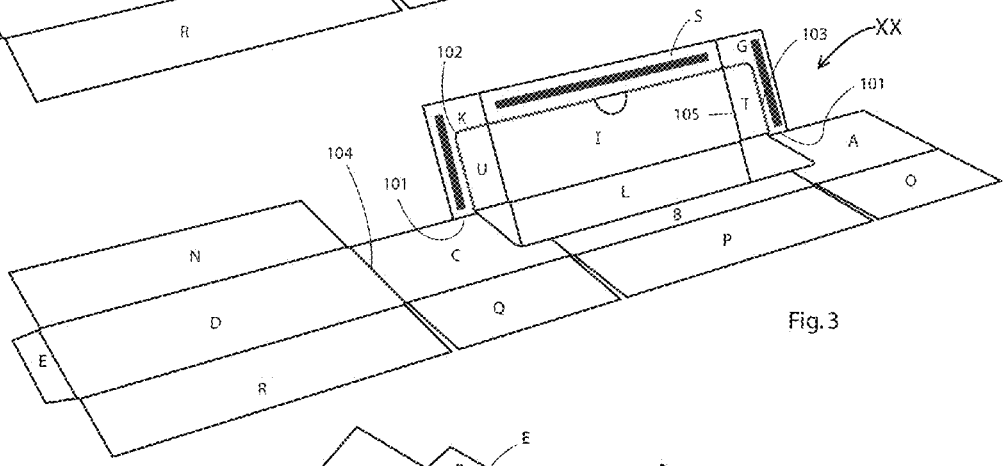
Figure 4:
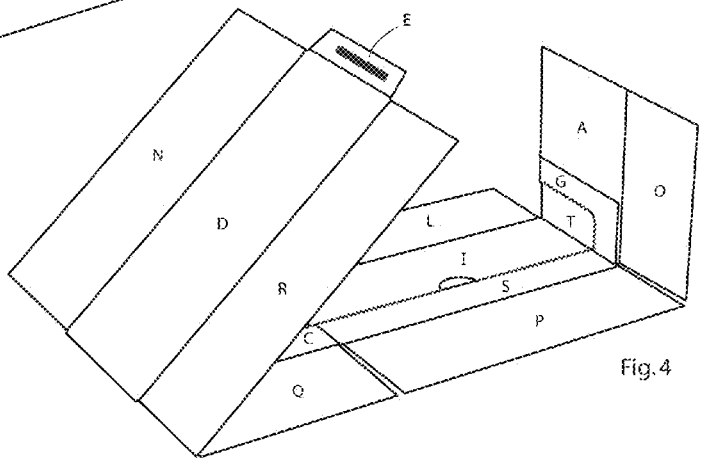
Figure 5:
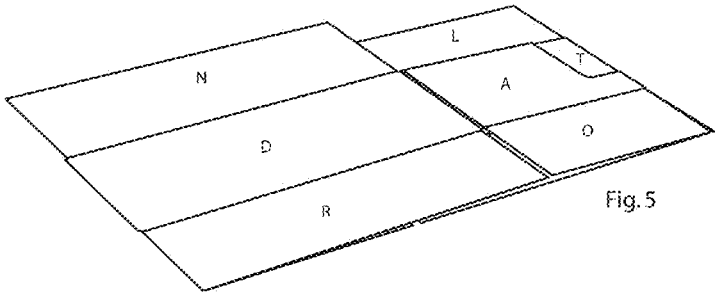
Figure 6:
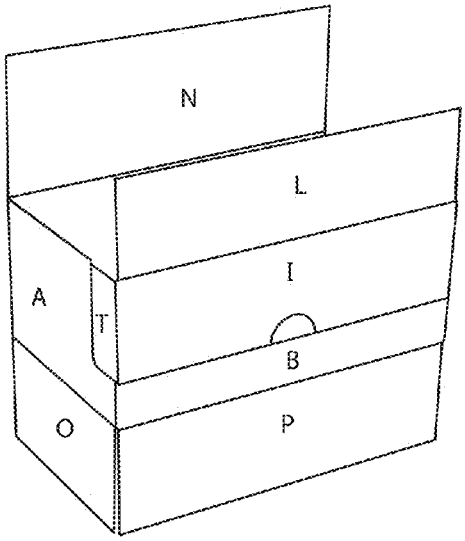
FIGS. 6-8 illustrate perspective views of steps of manufacturing or erecting a container from the blank and pre-assembly of FIGS. 1-5.
Figure 7:
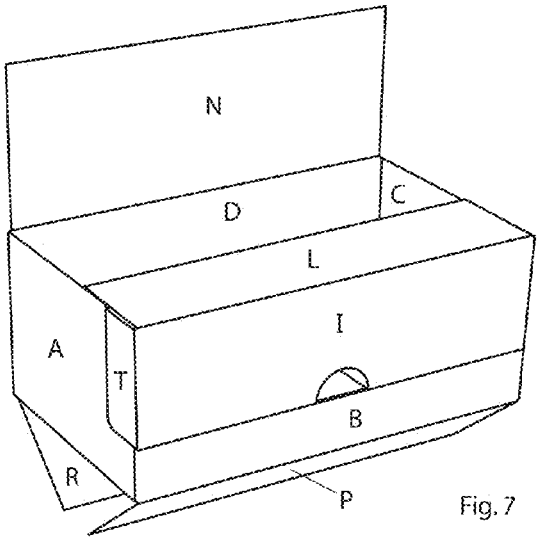
Figure 8:
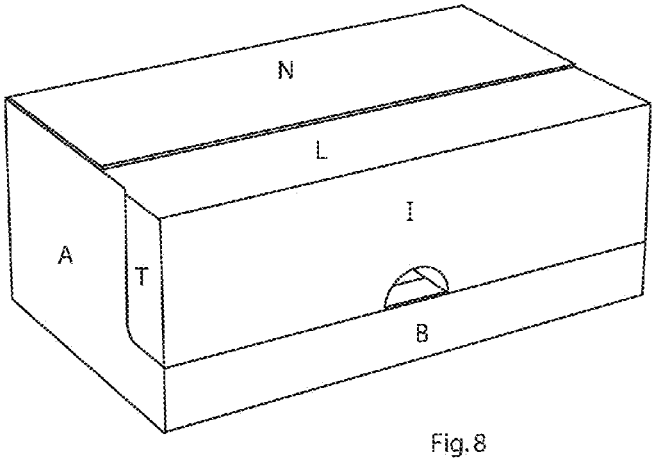
Figure 9:
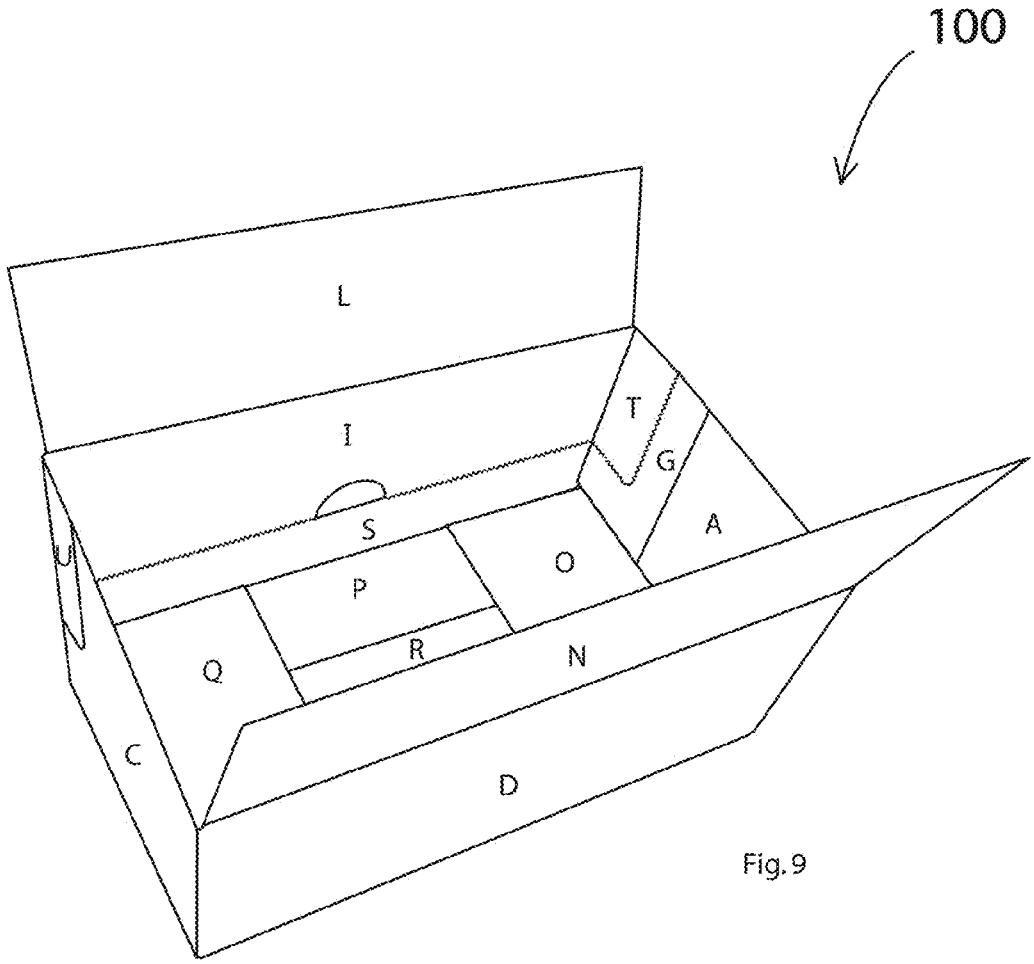
FIG. 9 illustrates a perspective view of a first step of closing the top of the container manufactured or erected from the container pre-assembly of FIG. 5.
Figure 10:
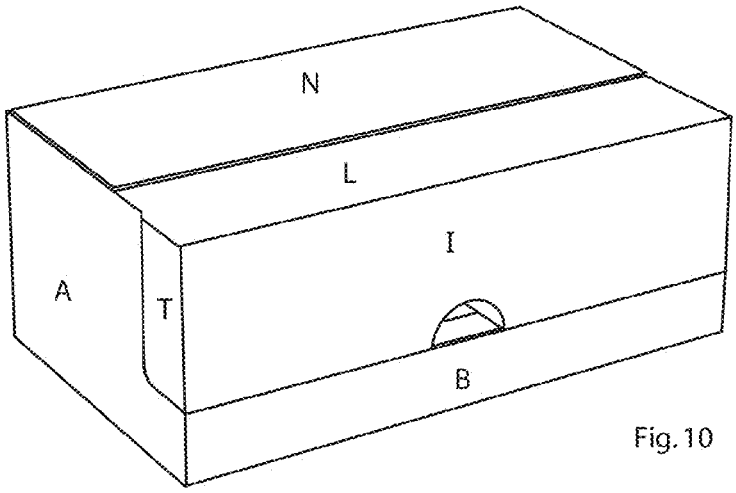
FIG. 10 illustrates a perspective view of a second step of closing the top of the container of FIG. 8 and showing flap (N) overlying flap (L).
Figure 13:
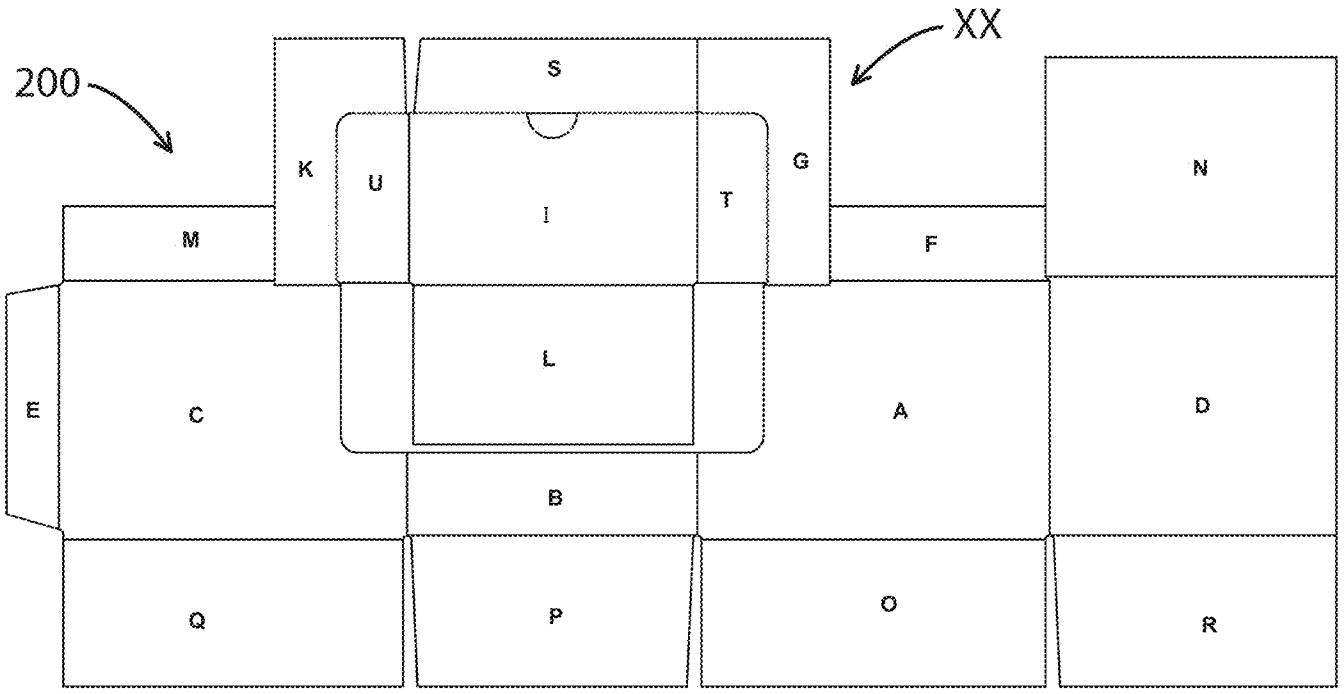
FIG. 13 illustrates a plan view of a blank used for manufacturing a container pre-assembly and a container in accordance with a second embodiment, according to the present disclosure.
Figure 14:
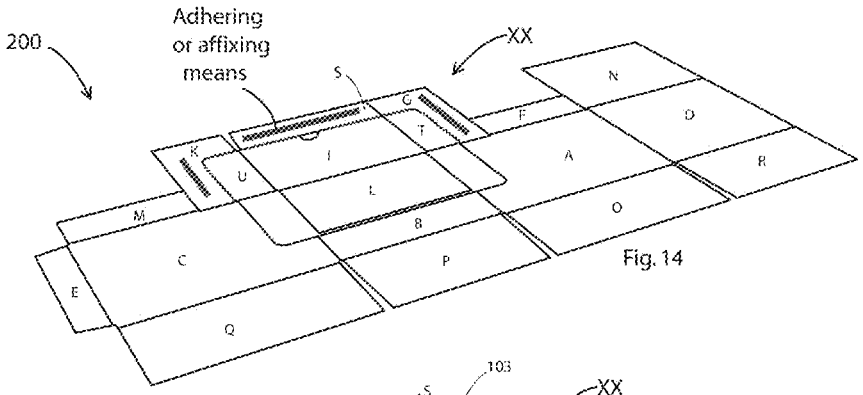
FIGS. 14-17 illustrate perspective views of steps of manufacturing a container pre-assembly from the blank of FIG. 13 and showing the rotation of a combination panel (XX) in FIGS. 14-16, in accordance with the present disclosure.
Figure 15:
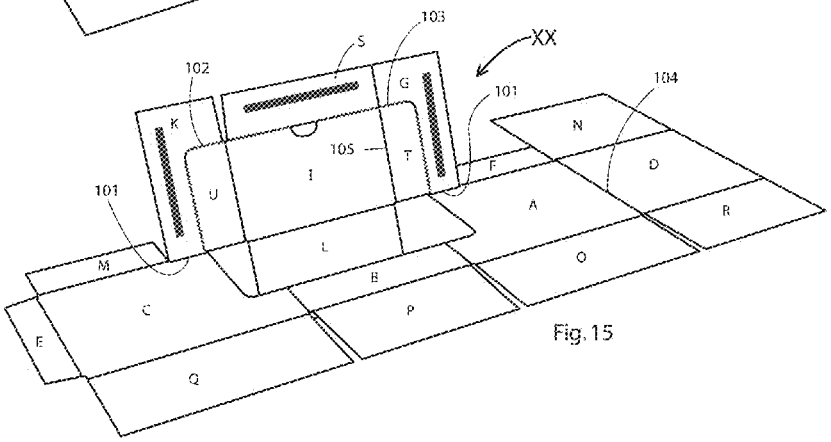
Figure 16:
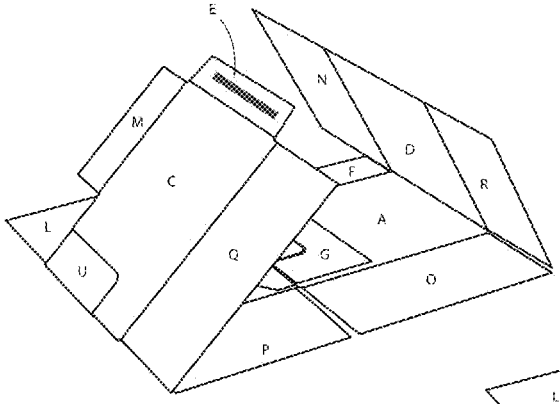
Figure 17:
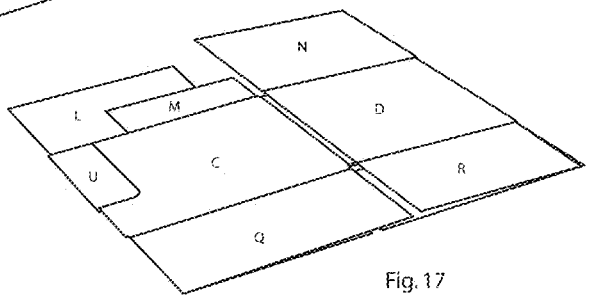
Figure 18:
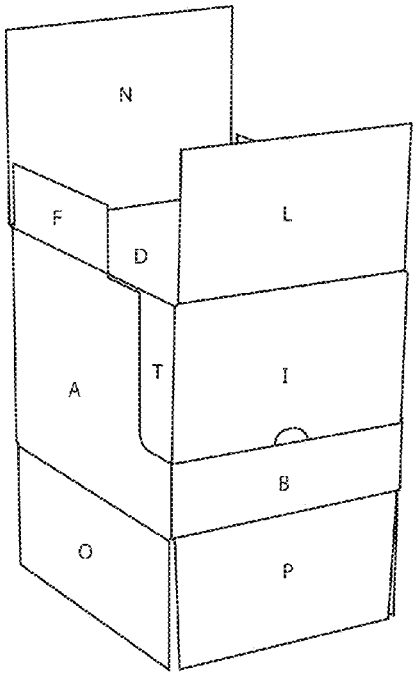
FIGS. 18-20 illustrate perspective views of steps of manufacturing or erecting a container from the blank and container pre-assembly of FIGS. 13-17.
Figure 19:
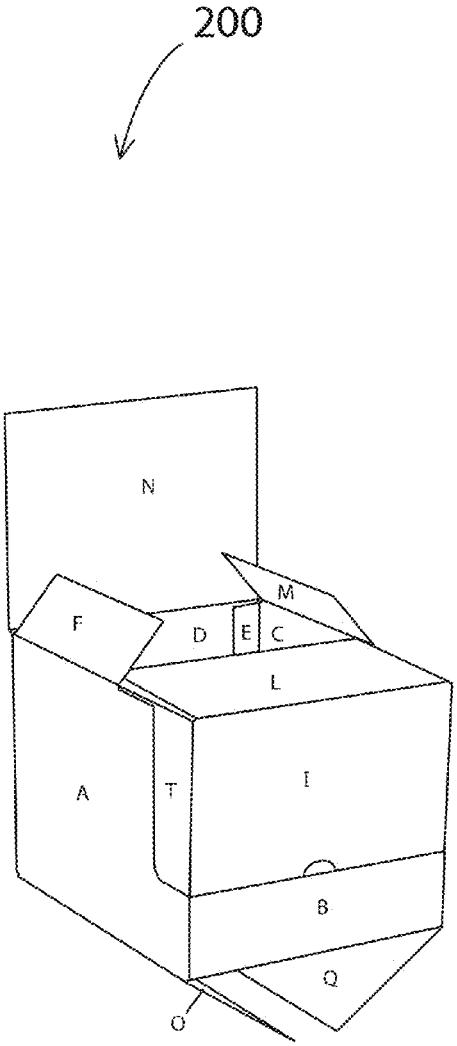
Figure 20:
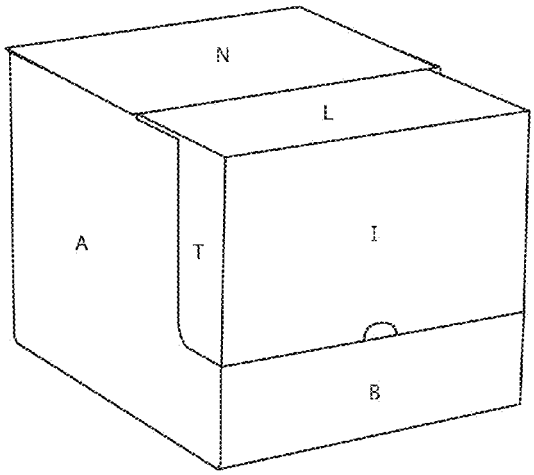
Figure 21:
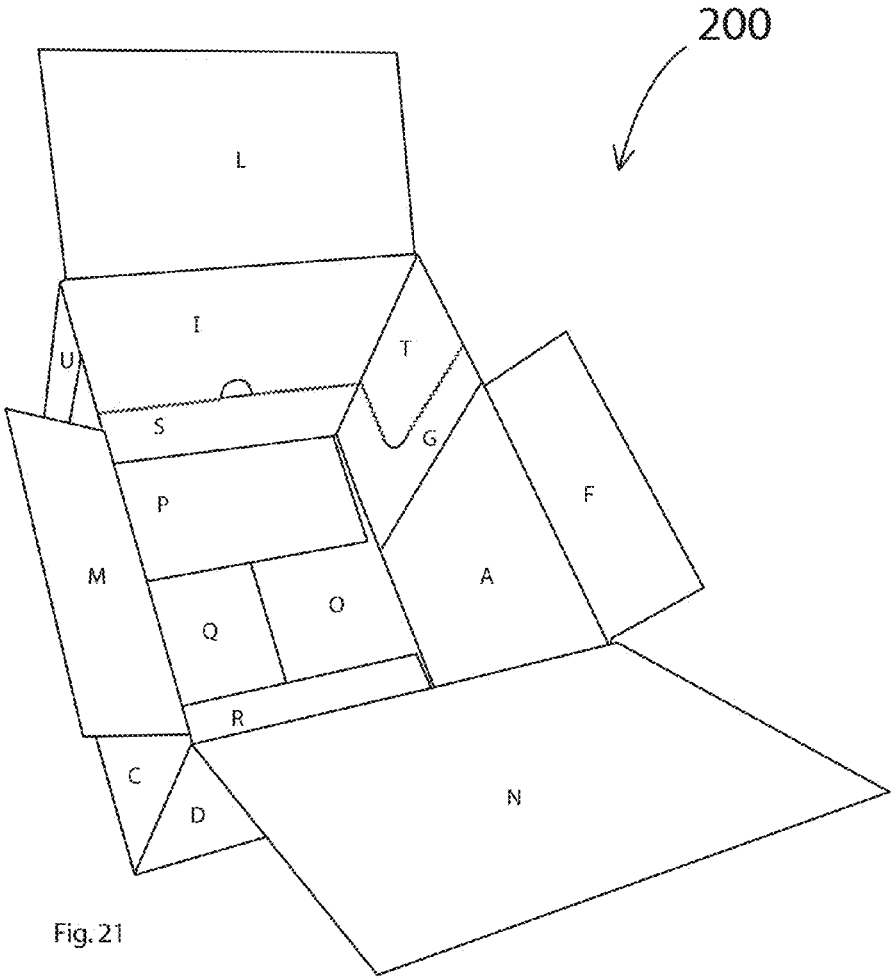
FIG. 21 illustrates a perspective view of a first step of closing the top of the container manufactured or erected from the container pre-assembly of FIG. 17.
Figure 22:
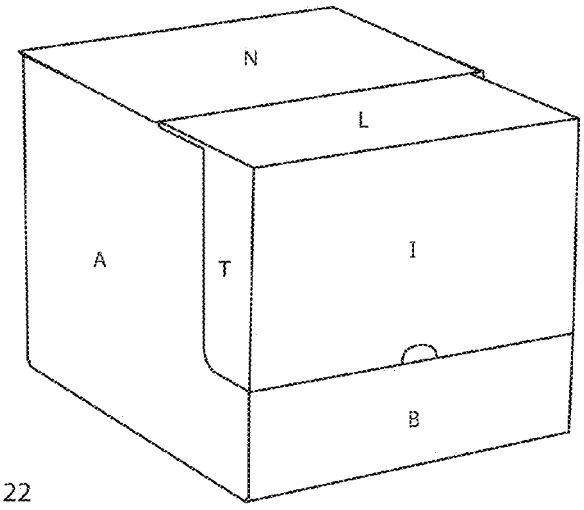
FIG. 22 illustrates a perspective view of a second step of closing the top of the container of FIG. 20 and showing flap (N) overlying flap (L).
Figure 25:
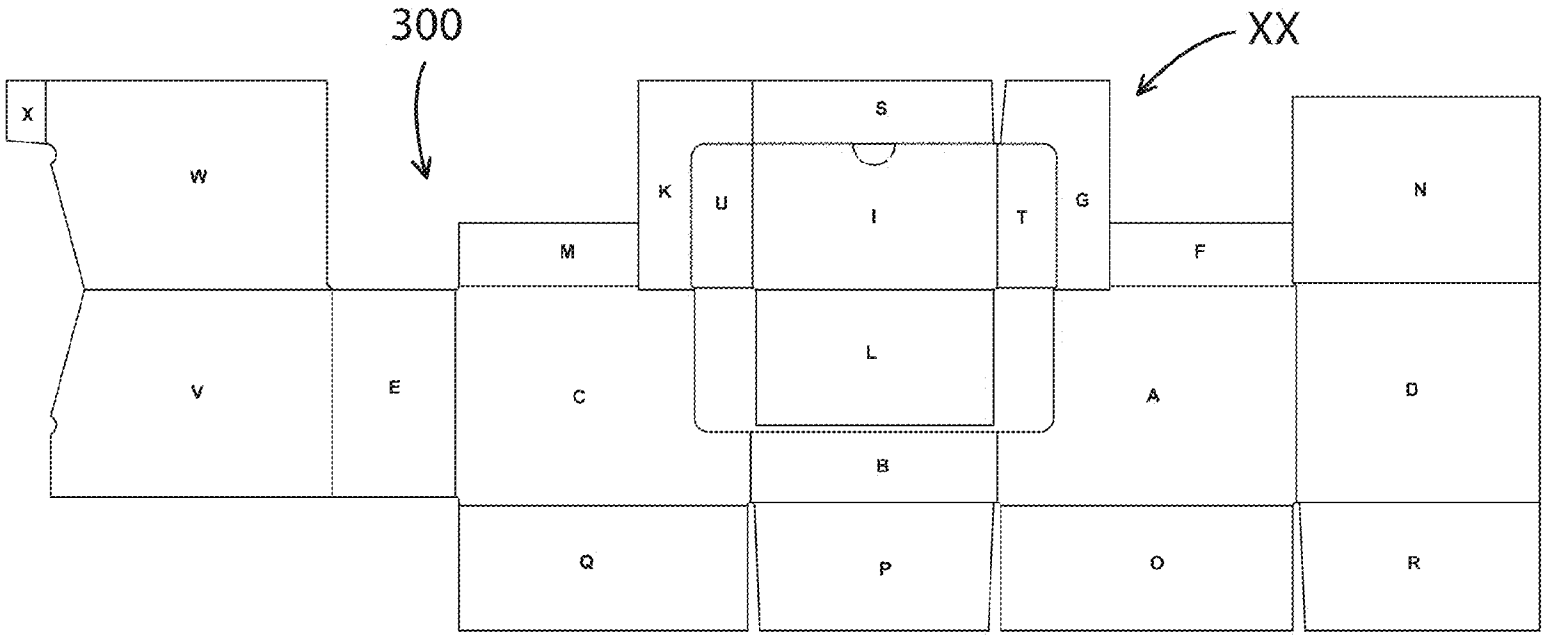
FIG. 25 illustrates a plan view of a blank used for manufacturing a container pre-assembly and a container in accordance with a third embodiment, according to the present disclosure.
Figure 26:
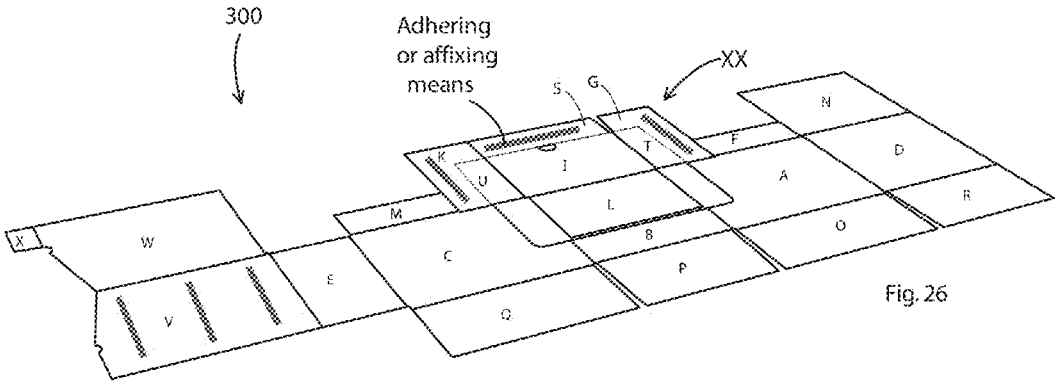
FIGS. 26-29 illustrate perspective views of steps of manufacturing a container pre-assembly from the blank of FIG. 25 and showing the rotation of a combination panel (XX) and the folding and formation of a divider panel (W, V) in FIGS. 26-28, in accordance with the present disclosure.
Figure 27:
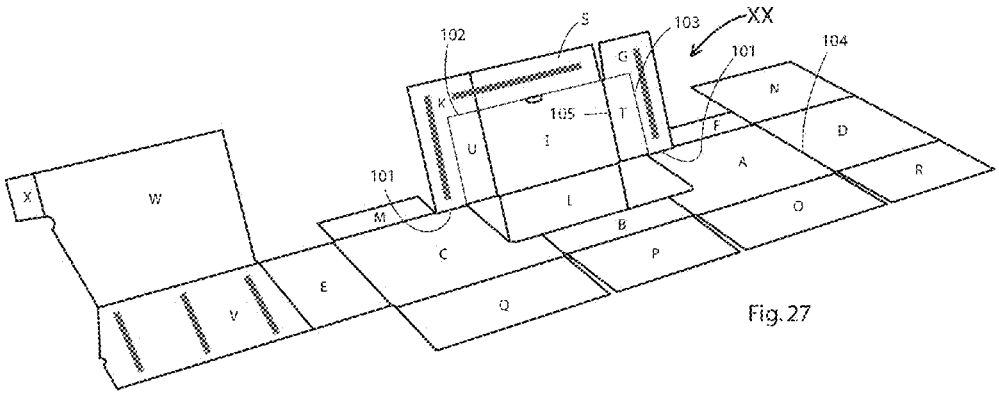
Figure 28:
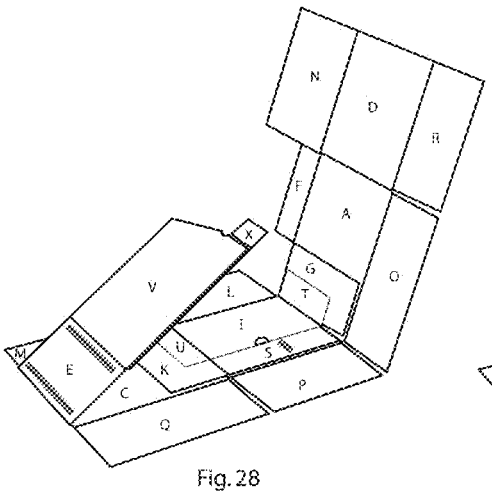
Figure 29:
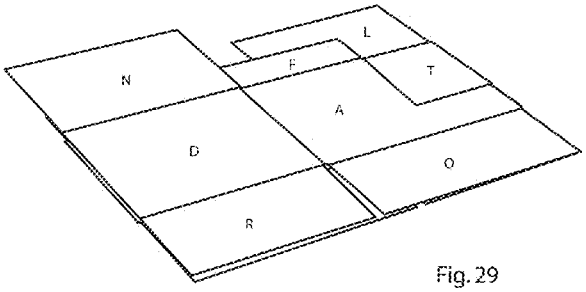
Figure 30:
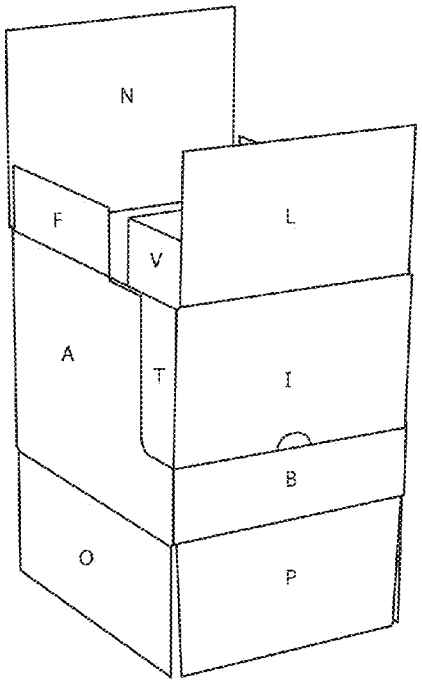
FIGS. 30-32 illustrate perspective views of steps of manufacturing or erecting a container from the blank and container pre-assembly of FIGS. 25-29.
Figure 31:
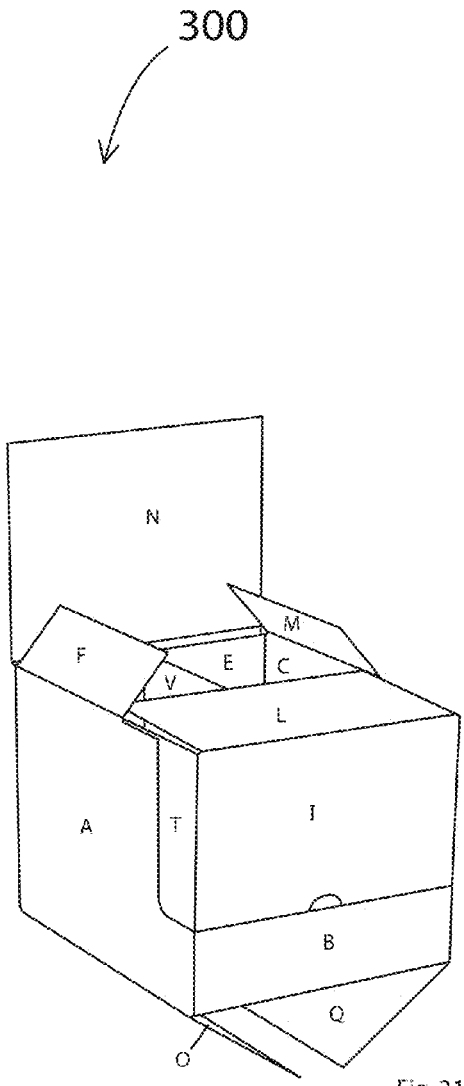
Figure 32:
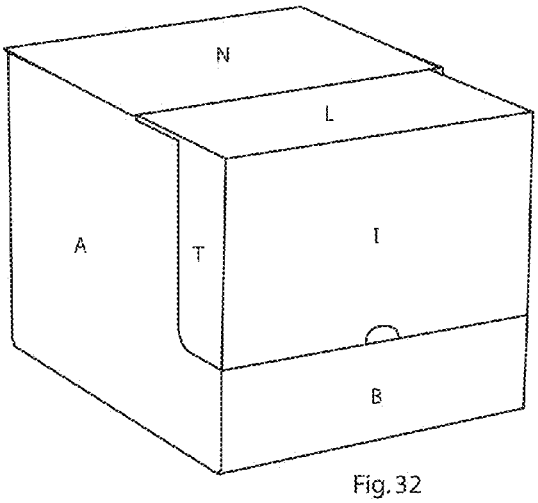
Figure 33:
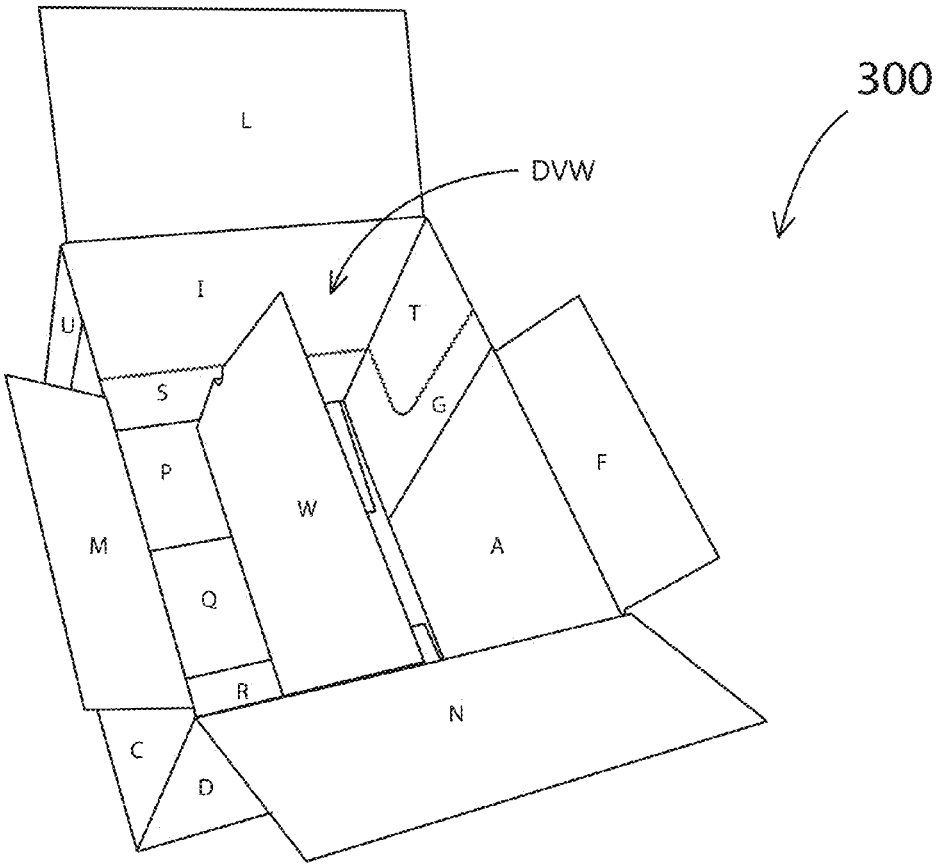
FIG. 33 illustrates a perspective view of a first step of closing the top of the container manufactured or erected from the container pre-assembly of FIG. 29.
Figure 34:
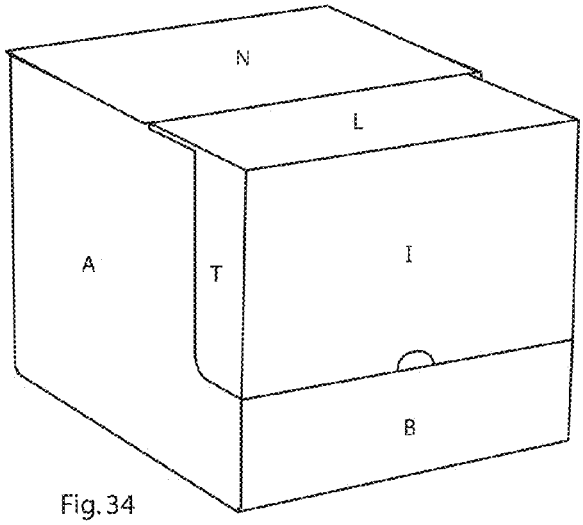
FIG. 34 illustrates a perspective view of a second step of closing the top of the container of FIG. 32 and showing flap (N) overlying flap (L).
Figure 37:
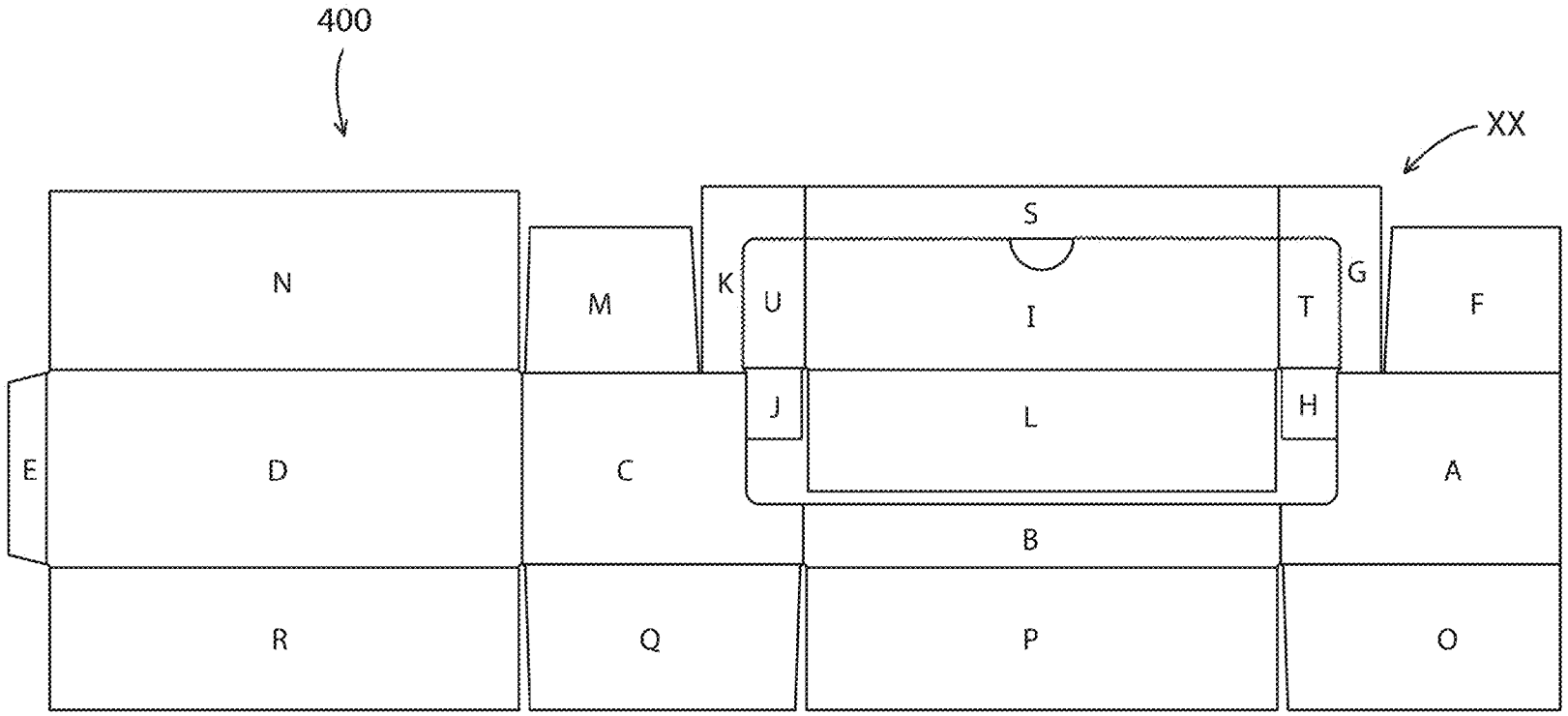
FIG. 37 illustrates a plan view of a blank used for manufacturing a container pre-assembly and a container in accordance with a fourth embodiment, according to the present disclosure.
Figure 38:
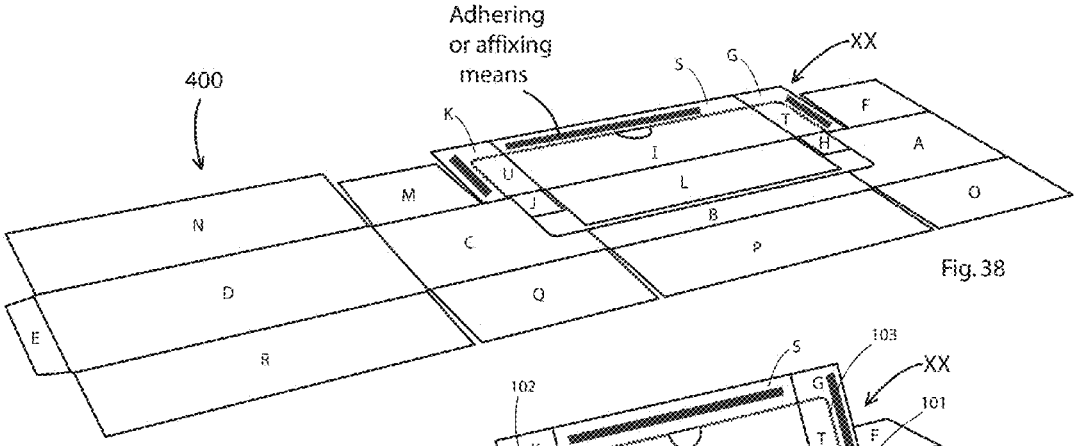
FIGS. 38-41 illustrate perspective views of steps of manufacturing a container pre-assembly from the blank of FIG. 37 and showing the rotation of a combination panel (XX) in FIGS. 38-40, in accordance with the present disclosure.
Figure 39:
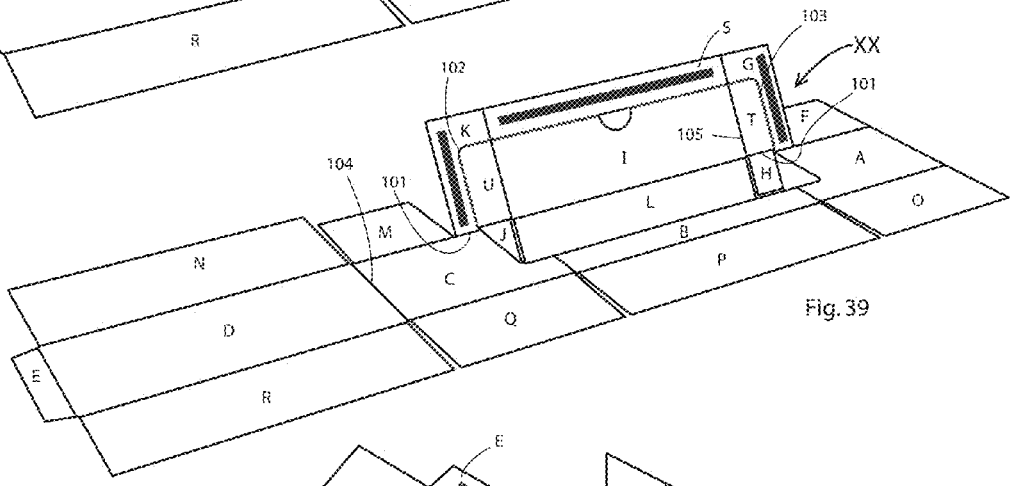
Figure 40:
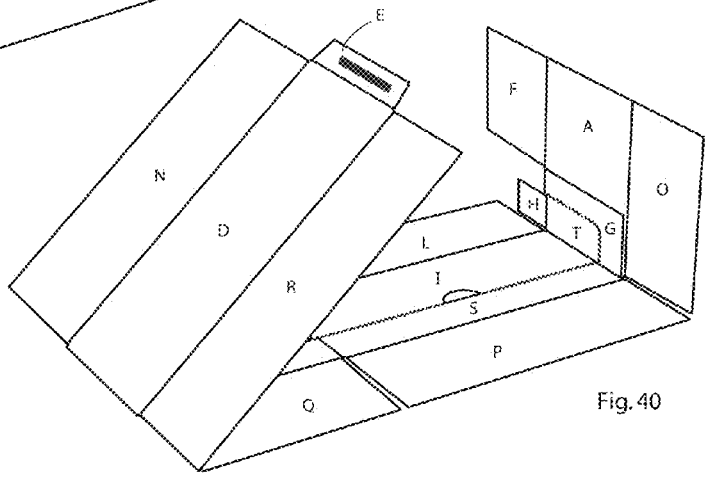
Figure 41:
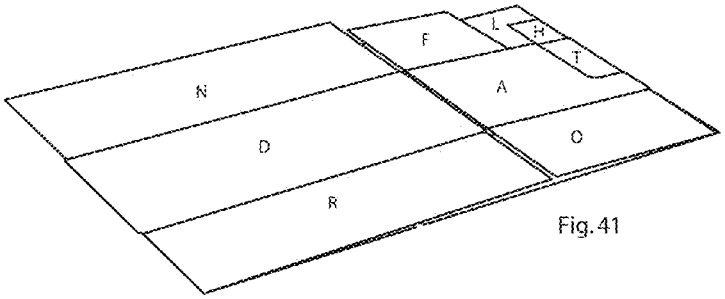
Figure 42:
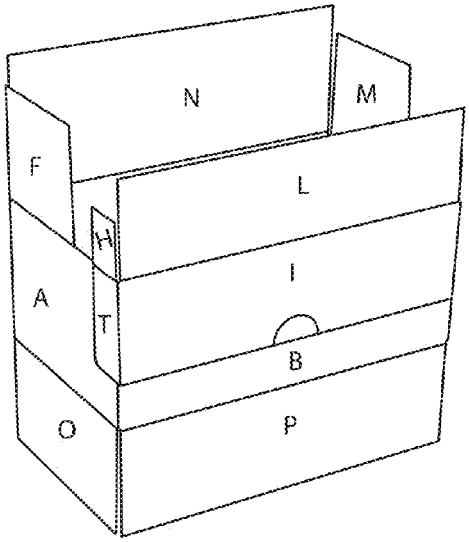
FIGS. 42-44 illustrate perspective views of steps of manufacturing or erecting a container from the blank and container pre-assembly of FIGS. 37-41.
Figure 43:
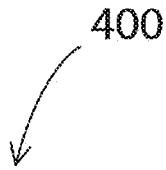
Figure 43:
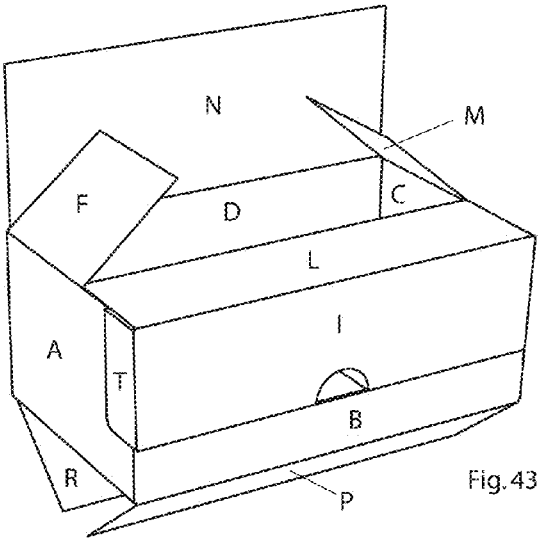
Figure 44:
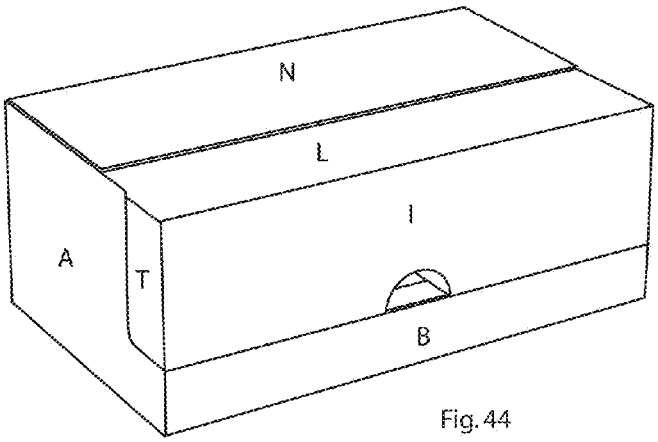
Figure 45:
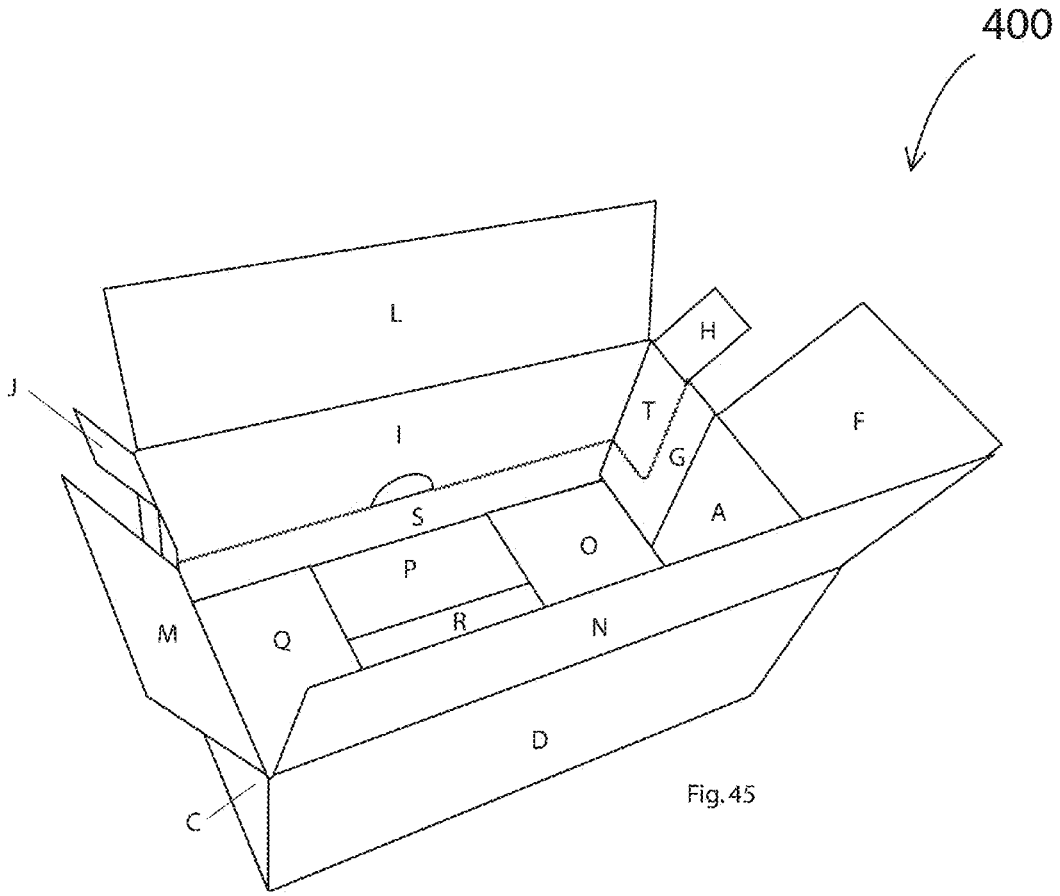
FIG. 45 illustrates a perspective view of a first step of closing the top of the container manufactured or erected from the container pre-assembly of FIG. 41 and showing flaps (F, M, L, N) and tabs (H, J) configured to close a top of the container.
Figure 46:
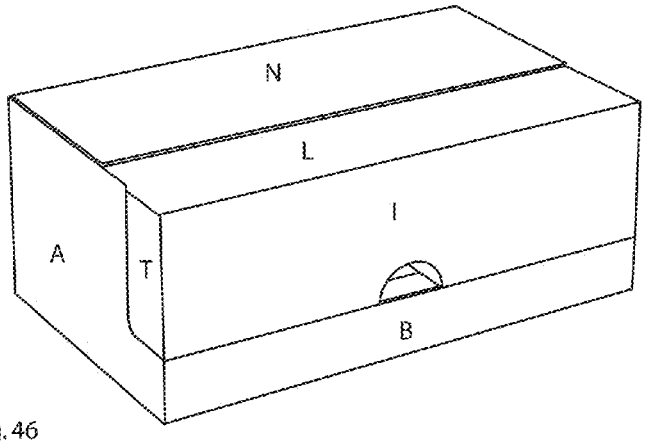
FIG. 46 illustrates a perspective view of a second step of closing the top of the container of FIG. 44 and showing flap (N) overlying flap (L).
Figure 49:
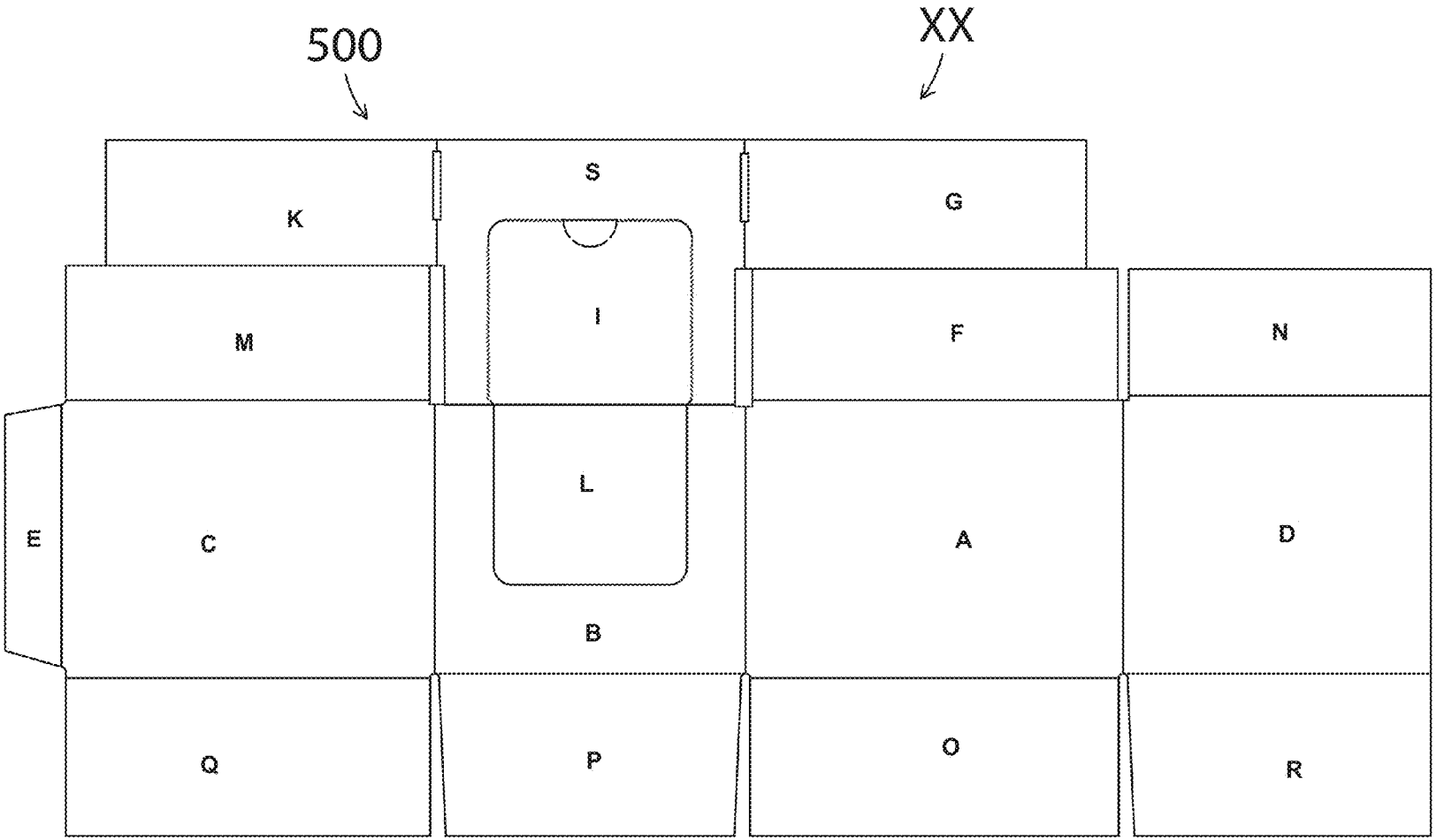
FIG. 49 illustrates a plan view of a blank used for manufacturing a container pre-assembly and a container in accordance with a third embodiment, according to the present disclosure.
Figure 50:
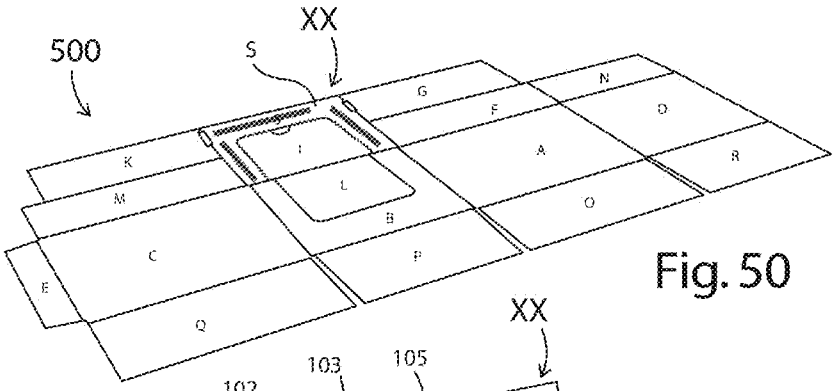
FIGS. 50-53 illustrate perspective views of steps of manufacturing a container pre-assembly from the blank of FIG. 49 and showing the rotation of a combination panel (XX) in FIGS. 50-51, in accordance with the present disclosure.
Figure 51:
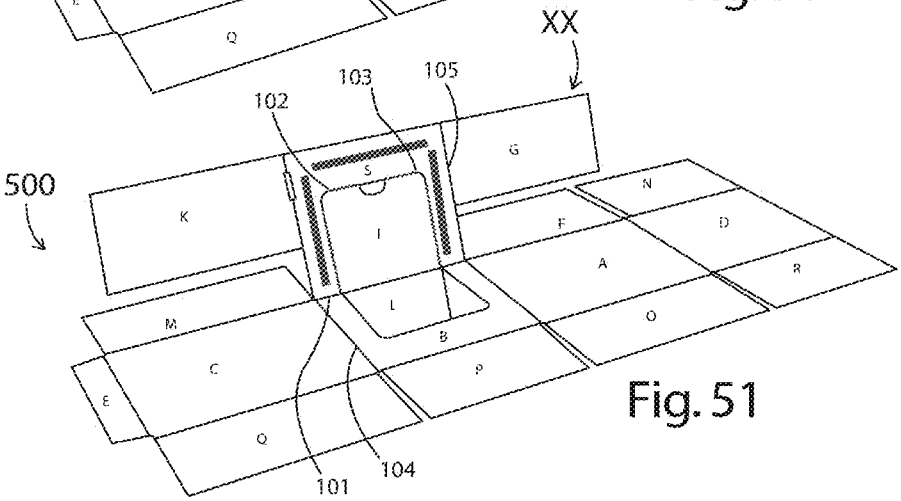
Figure 52:
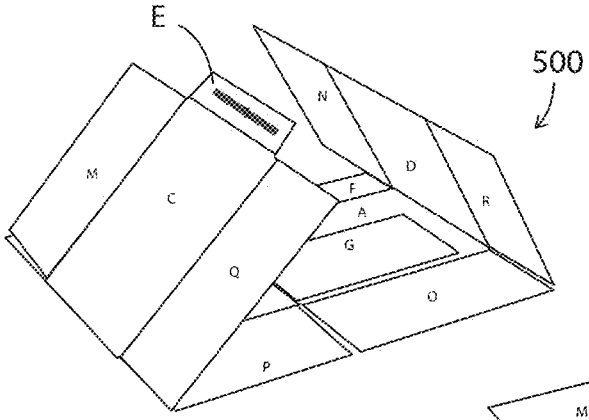
Figure 53:
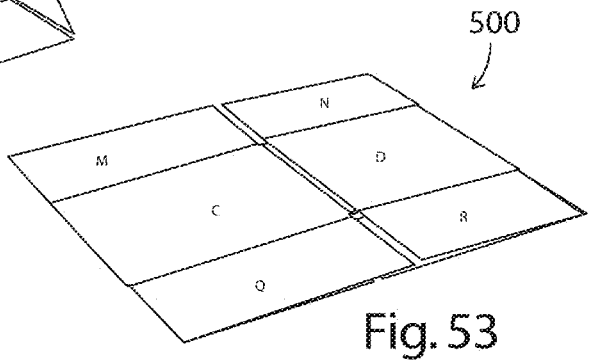
Figure 54:
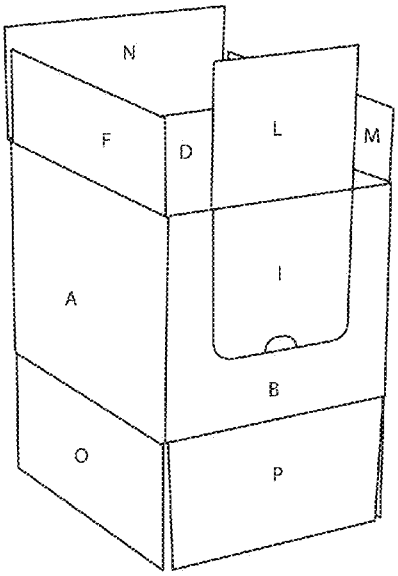
FIGS. 54-56 illustrate perspective views of steps of manufacturing or erecting a container from the blank and pre-assembly of FIGS. 49-53.
Figure 55:
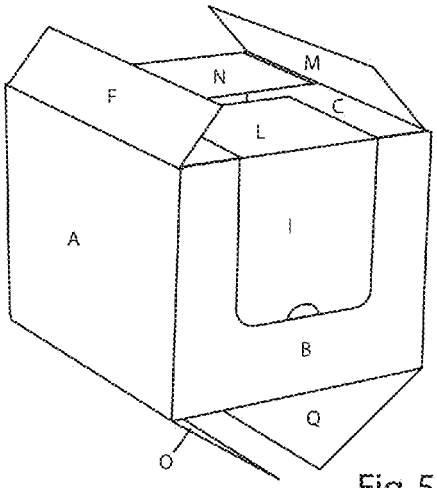
Figure 56:
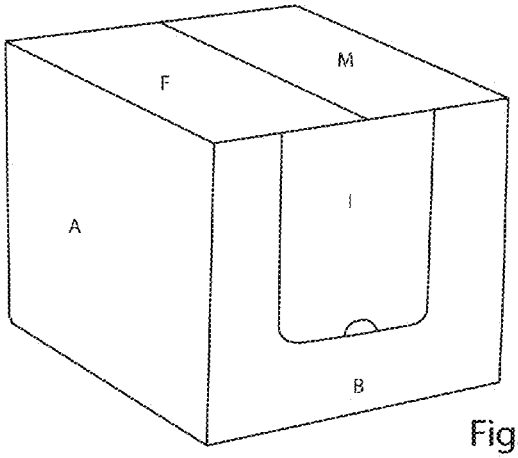
Figure 57:
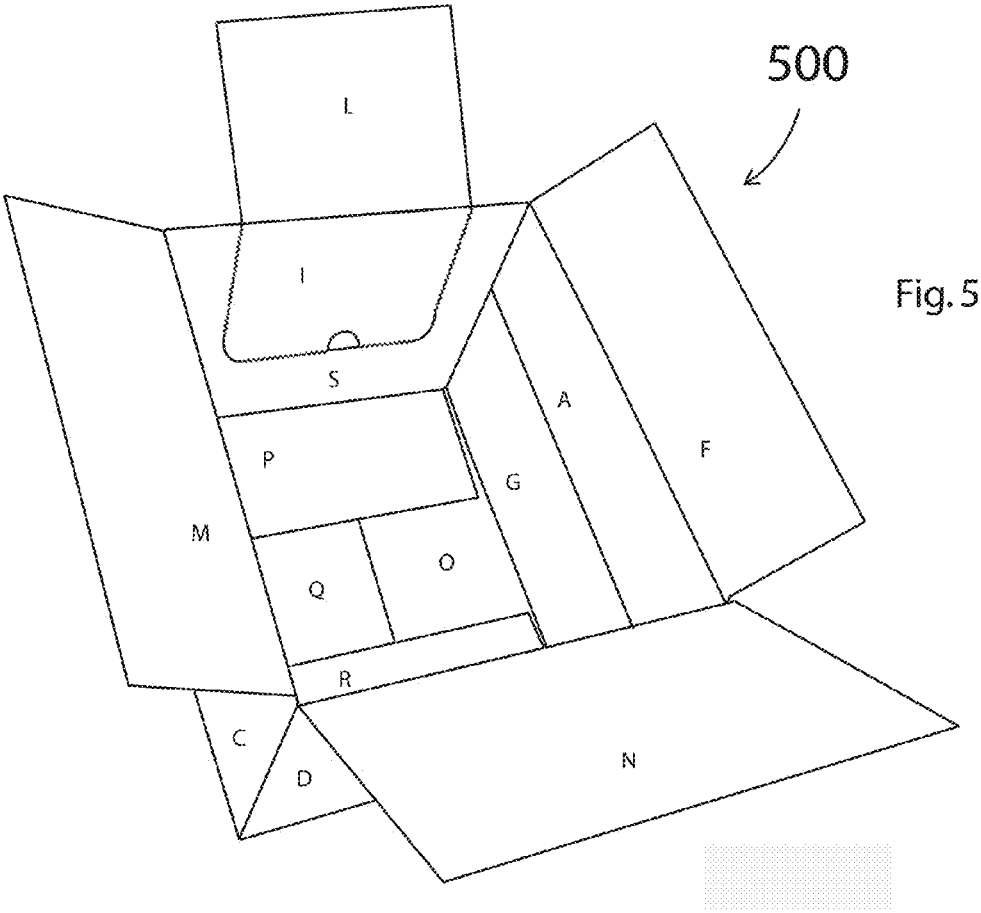
FIG. 57 illustrates a perspective view of a first step of closing the top of the container manufactured or erected from the container pre-assembly of FIG. 53.
Figure 58:
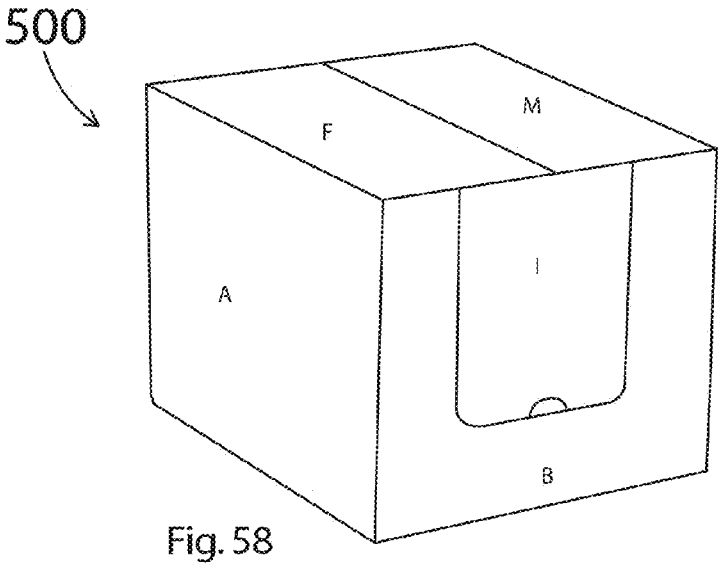
FIG. 58 illustrates a perspective view of a second step of closing the top of the container of FIG. 57 and showing flap (N) overlying flap (L).

Thus, one of the key features of embodiments of the present disclosure (see FIGS. 1-48) includes a blank that includes a combination panel (XX). The combination panel (XX) includes a top panel (L), portions of panels designated as front panels (S, I), end areas (G, K), and tab portions (T, U). The combination panel (XX) may also include top panel tabs (H, J). An advantageous feature of the combination panel (XX) is that it is configured to rotate about hinge lines or score lines (101) which rotation causes what would conventionally be considered as a top panel of a container (see panel (I) and its position on the blank in FIG. 2) to convert into a front panel and thus is designated herein as a third portion of the front panel (I)) (see FIG. 4). Similarly, the rotation of the combination panel (XX) causes what would conventionally be considered as a front panel of a container (see panel (L) and its position on the blank in FIG. 2) to convert into a top panel and thus is designated herein as a second top panel (L) (See FIG. 4). This simple advantage of rotating the combination panel (XX) and the placement of selected panels (L, S, I), end areas (G, K), and tab portions (T, U) provides for a tear-out section (Z) (see FIGS. 11 and 12A-12C, for example) that allows access to the product in the container, provides for a reinforced remaining front panel portions (S, B), and hides perforation edges (102, 103, 106) after the tear-out section (Z) is separated from the container.

Other features of embodiments of the present disclosure, as noted above, include the window tear-out section (Z) that provides access to an interior of the container for the ultimate purchaser of the product displayed in the container. In addition, perforated edge (106) of the tear-out section (Z) is recessed behind a part of the remaining front panel (S, B) that is left after the tear-out section (Z) is separated from the container. Also, other perforated edges (102, 103) of the tear-out section (Z) are recessed behind the first and second end areas (G, K) of the combination panel (XX) after the tear-out section (Z) is separated at those edges (102, 103) from the container. The recessing of the perforated edges (102, 103, 106) forming recessed portions RP gives the front of the container a clean appearance on, for example, a retailer's shelf. The ragged or torn perforated edges or perforations are not seen by the consumer when viewing the container from a front of the container.

Additional features of embodiments of the present disclosure include the first top panel (N) configured and acting as a stacking support so that multiple containers can be vertically stacked upon one another even after the tear-out section (Z) is separated from the containers. Also, there is the advantageous feature of the remaining front panels (S. B), after the tear-out section (Z) is removed, being reinforced as a result of the combination panel (XX) being rotated on the blank such that the first and second portions of the front panel (S, B) are adhered to each other during manufacturing of the container pre-assembly.

A blank, container preassembly and container, according to embodiments of the present disclosure, may be configured such that, for example, in a first embodiment 100 (see FIGS. 1-12) a combination panel (XX) includes a tear-out section (Z) that is aligned along a length of the container representing a width (Y1) of the container, and the tear-out section (Z) includes the second top panel (L), the third portion of the front panel (I), and the first and second tab portions (T, U) which tear-out section (Z) is shown to have been removed from the container by tearing along perforations or perorated lines (102, 103, 106) (see FIG. 11 and FIGS. 12A-C). In forming the pre-assembly of FIG. 5, the blank of embodiment 100 is folded such that panel (S) is adhered to panel (B), panel (K) is adhered to panel (C), panel (G) is adhered to panel (A), and tab (E) is adhered to panel (A). When the container of embodiment 100 is erected, panels (G), (S), and (K) are recessed or are inboard from panels (A), (B), and (C), respectively, so as to provide added support adjacent the opening in the container when the tear-out section is removed.

In a second embodiment 200 (see FIGS. 13-24), the combination panel (XX) is similar to that of the first embodiment 100 except that the positioning of the combination panel (Z) is changed. That is, the rear panel (D) is connected to a different side panel (A), and the tab (E) extends from a different end panel (C). Moreover, additional top panels have been added in the form of third and fourth top panels (F, M) to provide added protection to prevent foreign materials from entering the container after it has been erected and product placed therein for shipment and/or storage. In addition, the tear-out section (Z) is now aligned with a different width (Y2) of the container located along a front of the container and representing a container that is designed to have more depth than width when used by a retailer. In forming the pre-assembly of FIG. 17, the blank of embodiment 200 is folded such that panel (S) is adhered to panel (B), panel (K) is adhered to panel (C), panel (G) is adhered to panel (A), and tab (E) is adhered to panel (D). When the container of embodiment 200 is erected, panels (G), (S), and (K) are recessed or are inboard from panels (A), (B), and (C), respectively, so as to provide added support adjacent the opening in the container when the tear-out section is removed.

In a third embodiment 300 (see FIGS. 25-36), the blank and the combination panel (XX) are similar to the second embodiment 200 except that divider panels (V, W) and an extension tab (X) are added to provide for a divider (DVW) feature used to provide added vertical stacking strength. During the manufacturing of the container pre-assembly, extension tab (X) is adhered to the second portion of the front panel (S). This provides added strength to the first and second portions of the front panel (S, B), thereby reducing the potential of a tearing-out of the remaining portions of the front panel (S, B) when product may be pushed forward. The divider panels (V, W) are folded and adhered to each other to form divider (DVW) and are provided not just only for the additional stacking strength but also to provide for a two-cell unit that keeps similar or different types of products in the container separated and ready for display when the tear-out section (Z) is removed. In forming the pre-assembly of FIG. 29, the blank of embodiment 300 is folded such that panel (S) is adhered to panel (B), panel (K) is adhered to panel (C), panel (G) is adhered to panel (A), and panel (E) is adhered to panel (D). When the container of embodiment 300 is erected, panels (G), (S), and (K) are recessed or are inboard from panels (A), (B), and (C), respectively, so as to provide added support adjacent the opening in the container when the tear-out section is removed.

In a fourth embodiment 400 (see FIGS. 37-48), the blank and the combination panel (XX) are similar to the first embodiment 100 except that additional top panels have been added in the form of third and fourth top panels (F, M) to provide added support and protection to prevent foreign materials from entering the container when it has been erected and product placed therein for shipment and/or storage. Third and fourth top panels (F, M) are located under first top panel (N) when the container pre-assembly is erected as the container and the first top panel (N) is in a closed position. Moreover, top panel tabs (H, J) have been added to the combination panel (XX) to provide similar foreign material protection and added support. However, top panel tabs (H, J) are located under second top panel (L) when the container pre-assembly is erected as the container and second top panel (L) is in a closed position. Top panel tabs (H, J) are configured to be part of the tear-out section (Z) and are removed when the tear-out section (Z) is separated from the container. In forming the pre-assembly of FIG. 41, the blank of embodiment 400 is folded such that panel (S) is adhered to panel (B), panel (K) is adhered to panel (C), panel (G) is adhered to panel (A), and tab (E) is adhered to panel (A). When the container of embodiment 400 is erected, panels (G), (S), and (K) are recessed or are inboard of panels (A), (B), and (C), respectively, so as to provide added support adjacent the opening in the container when the tear-out section is removed.

In a fifth embodiment 500 (see FIGS. 49-60C), the blank and the combination panel are similar to the third embodiment 300, except that the combination panel (XX) of the fifth embodiment 500 does not include the tab portions (T, U) of the third embodiment 300, and the tear-out section (Z) of the fifth embodiment 500 does not extend into the end panels (A, C) thereof. As such, the tear-out section (Z) of the fifth embodiment 500 is disposed entirely within the front and top portions of the erected container.

As described herein, including in the descriptions as well as in the claims and shown in the drawings, the term "adhering" or "affixing" or "adhering means" or "affixing means" can be accomplished by gluing or taping or their equivalent. Such adhering or affixing means may be placed on either one or both of the panels, end areas, or tabs to be adhered or affixed to each other. Such adhering or affixing means is shown in the drawings by solid bands of short or long lengths, as appropriate.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A method for manufacturing a container pre-assembly having a tear-out section, the method steps comprising:

providing a blank including at least one bottom panel, end panels, a rear panel, a tab extending from either the rear panel or one of the end panels, first top panel, a first portion of a front panel, and a combination panel, the combination panel including a second top panel, second and third portions of the front panel, first and second end areas, and hinge lines separating the second top panel and the third portion of the front panel;

rotating and folding the combination panel about the hinge lines such that the first and second end areas overlie the end panels, the second portion of the front panel overlies the first portion of the front panel, and the second top panel switches positions with the third portion of the front panel, thereby positioning the second top panel and the third portion of the front panel in their desired positions as part of the container pre-assembly;

adhering a respective portion of the first and second end areas to a respective portion of one of the end panels, and adhering the second portion of the front panel to the first portion of the front panel; and rotating and folding other panels of the blank such that the rear panel and one of the end panels are adhered together resulting in a flattened condition of the blank and thereby forming the container pre-assembly the container pre-assembly including a tear-out section, which tear-out section is configured to be removed when the container pre-assembly is erected into a container and, after removal of the tear-it section, perforated lines remaining on the second portion of the front panel are recessed and form recessed portions along the second portion of the front panel, the recessed portions hiding the remaining perforated lines.

2. The method according to claim 1, wherein the tear-out section includes the second top panel and the third portion of the front panel.

3. The method according to claim 1, further comprising the steps of providing divider panels and rotating the divider panels relative to each other such that the divider panels are affixed to each other to form a double-walled divider configured to divide an interior of a container when the container pre-assembly is erected to form the container.

4. The method according to claim 3, wherein the divider is exposed when the tear-out section is removed from the container when the container pre-assembly is erected to form the container.

5. The method according to claim 1, further comprising the step of providing third and fourth top panels, wherein the third and fourth top panels are configured to provide added stacking support and protection against foreign materials entering a container erected from the container pre-assembly, the third and fourth top panels being located under the first top panel when the container pre-assembly is erected to form the container.

6. A container pre-assembly having a tear-out section, the container pre-assembly comprising:

a blank including at least one bottom panel, end panels, a rear panel, a tab extending from either the rear panel or one of the end panels, a first top panel, a first portion of a front panel, and a combination panel;

the combination panel including a second top panel, second and third portions of the front panel, first and second end areas, and a hinge line separating the second top panel and the third portion of the front panel;

the combination panel being configured to be rotated and folded about the hinge lines such that the end areas overlie and are adhered to portions of the end panels, respectively, the second portion of the front panel overlies and is adhered to portions of the first portion of the front panel, and the second top panel switches positions with the third portion of the front panel upon the rotation and folding of the combination panel thereby placing the second top panel and the third portion of the front panel in desired positions as part of the container pre-assembly; and a tear-out section configured to be removed when the container pre-assembly is erected into a container and, after the tear-out section is removed, the erected container includes recessed portions that hide perforated lines remaining on the second portion of the front panel; and a plurality of other panels of the blank, the plurality of other panels being configured to be rotated and folded about fold lines, and the rear panel and one of the end panels are adhered together to form a flattened structure forming the container pre-assembly.

7. The container pre-assembly according to claim 6, wherein the tear-out section includes the second top panel and the third portion of the front panel.

8. The container pre-assembly according to claim 6, further comprising divider panels configured to rotate relative to and be adhered to one another to form a double-walled divider that divides an interior of a container when the container pre-assembly is erected to form the container.

9. The container pre-assembly according to claim 8, wherein the divider is exposed when the tear-out section is removed from the container when the container pre-assembly is erected to form the container.

10. The container pre-assembly according to claim 6, further comprising third and fourth top panels configured to provide added stacking support and protection against foreign materials entering a container erected from the container pre-assembly, the third and fourth panels being located under the first top panel when the container pre-assembly is erected to form the container.

11. A method of manufacturing a container having a tear-out section, the method steps comprising:

providing a blank including at least one bottom panel, end panels, a rear panel, a tab extending from either the rear panel or one of the end panels, a first top panel, a first portion of a front panel, and a combination panel;

the combination panel including a second top panel, second and third portions of the front panel, first and second end areas, and hinge lines, the combination panel including a tear-out section including the second top panel and the third portion of the front panel;

rotating the combination panel around the hinge lines such that the end areas overlie the end panels, the second portion of the front panel overlies the first portion of the front panel, and the second top panel switches positions with the third portion of the front panel to become, as desired, in position to be, respectively, the second top panel and the third portion of the front panel;

adhering the end areas to end panels, adhering the first and second portions of the front panel to each other, and adhering the rear panel to one of the end panels such that when the panels of the blank are manipulated to erect the container and to form an exterior and interior of the container, the tear-out section is positioned at least as part of a front of the erected container and configured to be separated from the erected container thereby providing access to the interior and leaving the first top panel in a closed position as a partial covering of the interior and as a stacking support that is configured to provide support for at least one container situated at least partially on top of the first panel top panel of the erected container.

12. The method according to claim 11, wherein comprising the step of providing divider panels and rotating the divider panels relative to each other such that the divider panels are affixed to each other to form a double-walled divider configured to divide an interior of the erected container.

13. The method according to claim 12, wherein the divider is exposed when the tear-out section is removed from the erected container.

14. The method according to claim 11, further comprising the step of providing third and fourth top panels, wherein the third and fourth top panels are configured to provide added stacking support and protection against foreign materials entering a container erected from the container pre-assembly, the third and fourth top panels being located under the first top panel when the first top panel is in a closed position.

15. A container having a tear-out section, the container comprising:

at least one bottom panel;

end panels;

a rear panel;

a tab extending from either the rear panel or one of the end panels;

a first top panel;

a first portion of a front panel;

a combination panel including a second top panel, second and third portions of the front panel and first and second end areas;

wherein the third portion of the front panel and the first and second end areas include a first recessed portion located below and running along a length of an upper edge of the first portion of the front panel and second and third recessed portions located adjacent and along an outside edge of the first and second end areas, respectively; and further wherein the combination panel includes a tear-out section, the tear-out section including the second top panel and the third portion of the front panel, and the tear-out section being configured to be separated from the container along perforated edges thereby providing access to an interior of the container and leaving the first top panel in place as a partial covering of the interior and as a stacking support, and the recessed portions being hidden when viewing the container from a front view of the container after the tear-out section is separated.

16. The container according to claim 15, wherein the tear-out section includes the second top panel and the third portion of the front panel.

17. The container according to claim 15, further comprising divider panels adhered to one another to form a double-walled divider that divides an interior of the container.

18. The container according to claim 17, wherein the divider is exposed when the tear-out section is removed from the container.

19. The container according to claim 15, further comprising third and fourth top panels configured to provide added stacking support and protection against foreign materials entering the container, the third and fourth top panels being located under the first top panel when the first top panel is in a closed position.

20. A blank for a container pre-assembly having a tear-out section, the blank comprising:

at least one bottom panel;

end panels;

a rear panel;

a tab extending from either the rear panel or one of the end panels;

a first top panel;

a first portion of a front panel;

a combination panel including a second top panel, second and third portions of the front panel, first and second end areas, and hinge lines;

the combination panel further including a tear-out section configured to be separable from the blank, the tear-out section including the second top panel and the third portion of the front panel, the third portion of the front panel configured to include a first recessed portion located below and running along a length of an upper edge of the first portion of the front panel, respectively; and wherein the combination panel is configured to be rotated along the hinge lines such that second top panel is configured to switch positions with the third portion of the front panel to achieve reversed positions as a result of the rotation when the panels of the blank are manipulated to form the container pre-assembly.

21. The blank according to claim 20, further comprising divider panels configured to rotate relative to and be adhered to one another to form a double-walled divider that divides an interior of a container when the container pre-assembly is erected to form the container.

22. The blank according to claim 20, further comprising third and fourth top panels configured to provide added stacking support and protection against foreign materials entering a container erected from the container pre-assembly, the third and fourth top panels being located under the first top panel when the container pre-assembly is erected to form the container and the first top panel is in a closed position on the erected container.

23. The container according to claim 20, wherein the first end area, the second portion of the front panel, and the second end area are recessed from a first end panel, a first portion of the front panel, and a second end panel, respectively, when the container is erected so as to provide added support adjacent an opening in the container after the tear-out section is separated.

* * * * *

UNITED STATES PATENT AND TRADEMARK OFFICE

CERTIFICATE OF CORRECTION

PATENT NO. : 9,290,294 B2
APPLICATION NO. : 14/539524
DATED : March 22, 2016
INVENTOR(S) : Jamie L. Laughman et al.

It is certified that error appears in the above-identified patent and that said Letters Patent is hereby corrected as shown below:

In the claims, claim 1, at column 9, line 56, delete the words "tear-it" and add in its place the words --tear-out--.

Signed and Sealed this
Fifth Day of July, 2016

Michelle K. Lee

Michelle K. Lee
*Director of the United States Patent and Trademark Office*